US010665197B2

(12) United States Patent
Ozaki

(10) Patent No.: US 10,665,197 B2
(45) Date of Patent: May 26, 2020

(54) DISPLAY DEVICE

(71) Applicant: Japan Display Inc., Minato-ku (JP)

(72) Inventor: Tadafumi Ozaki, Tokyo (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 16/386,724

(22) Filed: Apr. 17, 2019

(65) Prior Publication Data

US 2019/0325835 A1 Oct. 24, 2019

(30) Foreign Application Priority Data

Apr. 20, 2018 (JP) ..... 2018-081405

(51) Int. Cl.
*G09G 3/36* (2006.01)
*G09G 3/34* (2006.01)

(52) U.S. Cl.
CPC ..... *G09G 3/3677* (2013.01); *G09G 3/3413* (2013.01); *G09G 3/3614* (2013.01); *G09G 2320/0666* (2013.01)

(58) Field of Classification Search
CPC ... G09G 3/3677; G09G 3/3413; G09G 3/3614
USPC ..... 345/87, 212, 690
See application file for complete search history.

(56) References Cited

U.S. PATENT DOCUMENTS

2003/0137521 A1* 7/2003 Zehner ..... G02F 1/167 345/589
2010/0079440 A1 4/2010 Yamaguchi et al.
2017/0301273 A1* 10/2017 Atkinson ..... G09G 3/14
2017/0352327 A1* 12/2017 Hodges ..... G09G 5/10

FOREIGN PATENT DOCUMENTS

JP 2003-122314 4/2003
JP 2006-018125 1/2006
JP 2010-078902 4/2010

* cited by examiner

*Primary Examiner* — Calvin C Ma
(74) *Attorney, Agent, or Firm* — Oblon, McClelland, Maier & Neustadt, L.L.P.

(57) ABSTRACT

According to one embodiment, a display device includes a display panel, a light source unit and a control unit. The control unit sets a display area to a second transparent state in which a degree of transparency is higher than a degree of transparency of a first transparent state in a reset period. The control unit displays an image in an object area, sets a non-object area to the first transparent state and holds a non-rewrite area in the second transparent state in a rewrite period. The gate driver drives second gate lines at a second drive frequency higher than a first drive frequency at which the gate driver drives first gate lines or selectively drives the first gate lines in the rewrite period.

10 Claims, 20 Drawing Sheets

DISPLAY DEVICE

CROSS-REFERENCE TO RELATED APPLICATIONS

This application is based upon and claims the benefit of priority from Japanese Patent Application No. 2018-081405, filed Apr. 20, 2018, the entire contents of which are incorporated herein by reference.

FIELD

Embodiments described herein relate generally to a display device.

BACKGROUND

Recently, a display device comprising a polymer dispersed liquid crystal (hereinafter referred to as PDLC) panel, which can switch between a diffusing state of diffusing incident light and a transmitting state of allowing incident light to pass through, and configured to display an image and also allow the user to see the background through it has been proposed. In this display device, one frame period includes a plurality of sub-frame periods. By displaying an image while switching a display color in each sub-frame period, multicolor display is realized.

DETAILED DESCRIPTION

Figure 1:
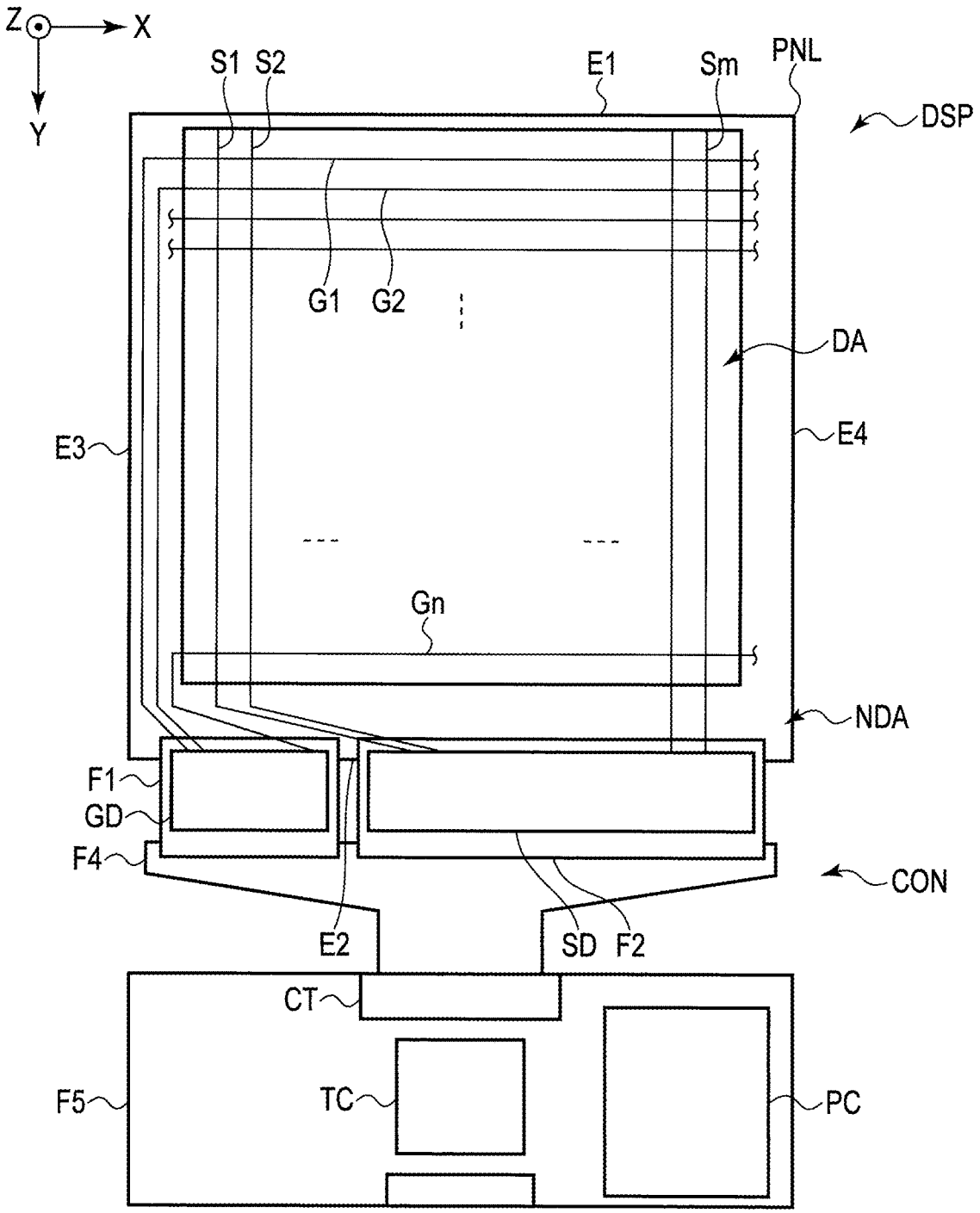
FIG. 1 is a plan view showing a configuration example of a display device according to a first embodiment.

In general, according to one embodiment, there is provided a display device comprising a display panel, a light source unit and a control unit. The display panel comprises a plurality of gate lines, a plurality of pixel electrodes located in a display area, a common electrode located in the display area, and a display function layer located in the display area. The light source unit is located in a non-display area outside the display area and emits light to the display function layer. The control unit includes a gate driver connected to the gate lines and controls drive of the gate lines, the pixel electrodes, the common electrode and the light source unit. At a time of image display in an object area of the display area, the control unit sets the display area to a second transparent state in which a degree of transparency is higher than a degree of transparency of a first transparent state in a reset period, displays an image in the object area, sets a non-object area other than the object area of a rewrite area which includes an entire area of rows in which the object area is located, to the first transparent state, and holds a non-rewrite area other than the rewrite area of the display area in the second transparent state in a rewrite period after the reset period. The gate driver includes a sequential circuit and drives a plurality of second gate lines electrically connected to the pixel electrodes located in the non-rewrite area of the gate lines, at a second drive frequency higher than a first drive frequency at which the gate driver drives a plurality of first gate lines electrically connected to the pixel electrodes located in the rewrite area of the gate lines in the rewrite period, or includes a decoder and selectively drives the first gate lines in the rewrite period.

Embodiments will be described hereinafter with reference to the accompanying drawings. The disclosure is merely an example, and proper changes in keeping with the spirit of the invention, which are easily conceivable by a person of ordinary skill in the art, come within the scope of the invention as a matter of course. In addition, in some cases, in order to make the description clearer, the widths, thicknesses, shapes, etc., of the respective parts are illustrated schematically in the drawings, rather than as an accurate representation of what is implemented. However, such schematic illustration is merely exemplary, and in no way restricts the interpretation of the invention. In addition, in the specification and drawings, the same elements as those described in connection with preceding drawings are denoted by like reference numbers, and detailed description thereof is omitted unless necessary.

In each embodiment, a display device employing polymer dispersed liquid crystal will be described as an example of the display device. The display device of each embodiment can be used in various devices such as a smartphone, a tablet computer and a mobile phone.

First Embodiment

FIG. 1 is a plan view showing a configuration example of a display device DSP according to the present embodiment.

As shown in FIG. 1, a first direction X and a second direction Y are directions intersecting each other, and a third direction Z is a direction intersecting the first direction X and the second direction Y. The first direction X corresponds to a row direction, and the second direction Y corresponds to a column direction. For example, the first direction X, the second direction Y and the third direction Z orthogonally intersect each other but may intersect at an angle other than 90 degrees. In the present specification, a direction toward the pointing end of an arrow indicating the third direction Z is referred to as upward (or merely above) and a direction toward the opposite side of the pointing end is referred to as downward (or merely below).

The display device DSP comprises a display panel PNL, circuit boards (wiring substrates) F1, F2, F4 and F5 and the like. The display panel PNL comprises a display area DA on which an image is displayed and a frame-shaped non-display area NDA which surrounds the display area DA. The display area DA comprises n gate lines G (G1 to Gn), m source lines S (S1 to Sm) and the like. Each of n and m is a positive integer, and n and m may be equal to each other or may be different from each other. The gate lines G extend in the first direction X and are spaced apart and arranged in the second direction Y. In other words, the gate lines G extend in the row direction. The source lines S extend in the second direction Y and are spaced apart and arranged in the first direction X. The display panel PNL has end portions E1 and E2 extending in the first direction X and end portions E3 and E4 extending in the second direction Y.

The circuit board F1 comprises a gate driver GD. The gate lines G are connected to the gate driver GD. The circuit board F2 comprises a source driver SD. The source lines S are connected to the source driver SD. The circuit boards F1 and F2 are each connected to the display panel PNL and the circuit board F4. The circuit board F5 comprises a timing controller TC, a power supply circuit PC and the like. The circuit board F4 is connected to a connector CT of the circuit board F5. Note that the circuit boards F1 and F2 may be replaced with a single circuit board. Alternatively, the circuit boards F1, F2 and F4 may be replaced with a single circuit board. The above-described gate driver GD, source driver SD and timing controller TC constitute a control unit CON of the present embodiment, and the control unit CON controls drive of the gate lines G, the source lines S, pixel electrodes which will be described later, a common electrode which will be described later, and a light source unit which will be described later.

Figure 2:
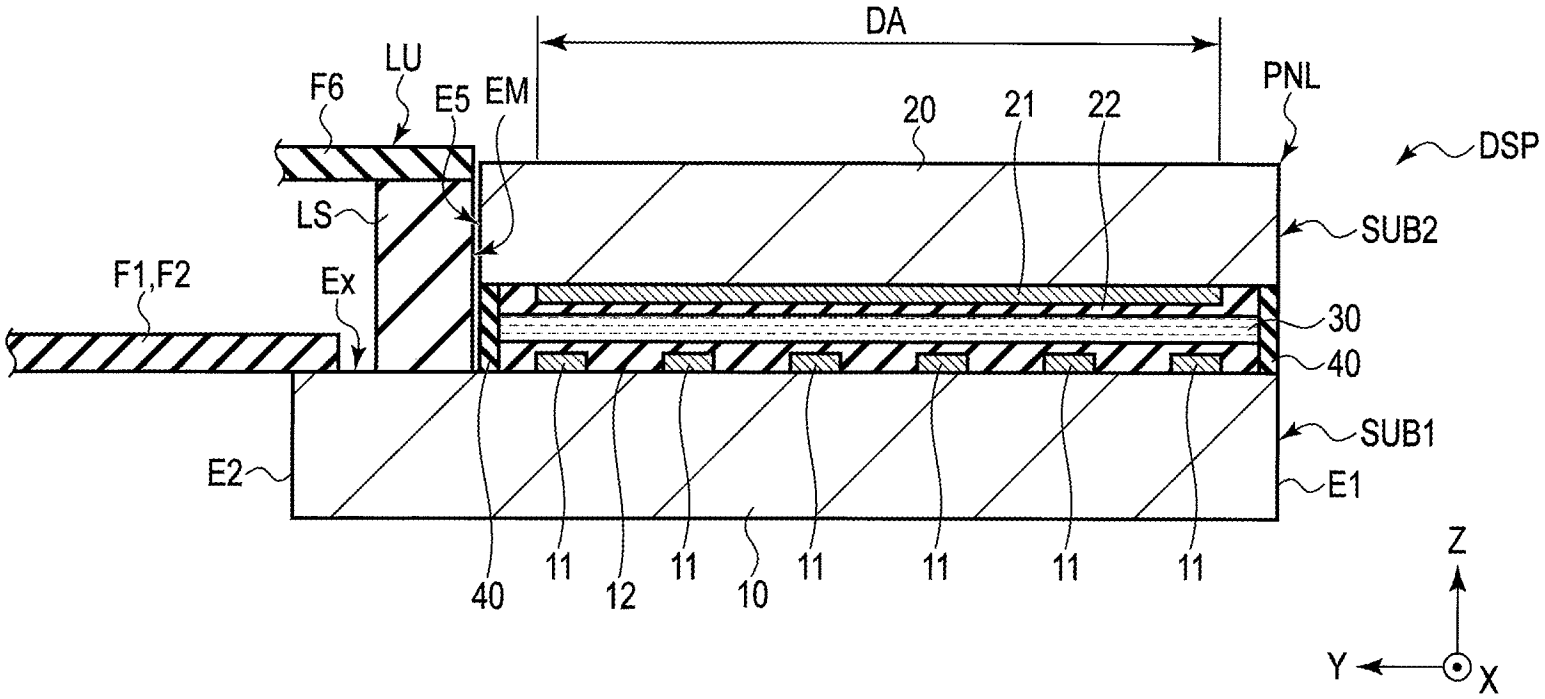
FIG. 2 is a cross-sectional view of the display device shown in FIG. 1.

FIG. 2 is a cross-sectional view of the display device DSP shown in FIG. 1. Only main portions in the cross-section of the display device DSP in a Y-Z plane defined by the second direction Y and the third direction Z will be described here.

As shown in FIG. 2, the display panel PNL comprises a first substrate SUB1, a second substrate SUB2, a liquid crystal layer 30 as a display function layer, and the like. The first substrate SUB1 comprises a transparent substrate 10, pixel electrodes 11, an alignment film 12 and the like. The second substrate SUB2 comprises a transparent substrate 20, a common electrode 21, an alignment film 22 and the like. The pixel electrodes 11 and the common electrode 21 are formed of, for example, a transparent conductive material such as indium tin oxide (ITO) or indium zinc oxide (IZO). The liquid crystal layer 30 is located at least in the display area DA. The liquid crystal layer 30 includes polymer dispersed liquid crystal and is located between the alignment film 12 and the alignment film 22. The liquid crystal layer 30 of the present embodiment employs reverse-mode polymer dispersed liquid crystal (R-PDLC). The above-described liquid crystal layer 30 maintains the degree of parallelism of incident light in a case where an applied voltage is low, and scatters incident light in a case where an applied voltage is high. The first substrate SUB1 and the second substrate SUB2 are bonded together by a sealing member 40. The first substrate SUB1 has an extension portion EX extending in the second direction Y beyond an end portion E5 of the transparent substrate 20.

The circuit boards F1 and F2 are connected to the extension portion EX of the first substrate SUB1.

A light source unit LU is located in the non-display area NDA outside the display area DA. The light source unit LU comprises a light-emitting element LS, a circuit board F6 and the like. The light-emitting element LS is connected to the circuit board F6 and is located on the extension portion EX. The light-emitting element LS has an emission portion (emission surface) EM opposed to the end portion E5. Illumination light emitted from the emission portion EM is made incident on the end portion E5 and propagates through the display panel PNL as will be described later.

Figure 3:
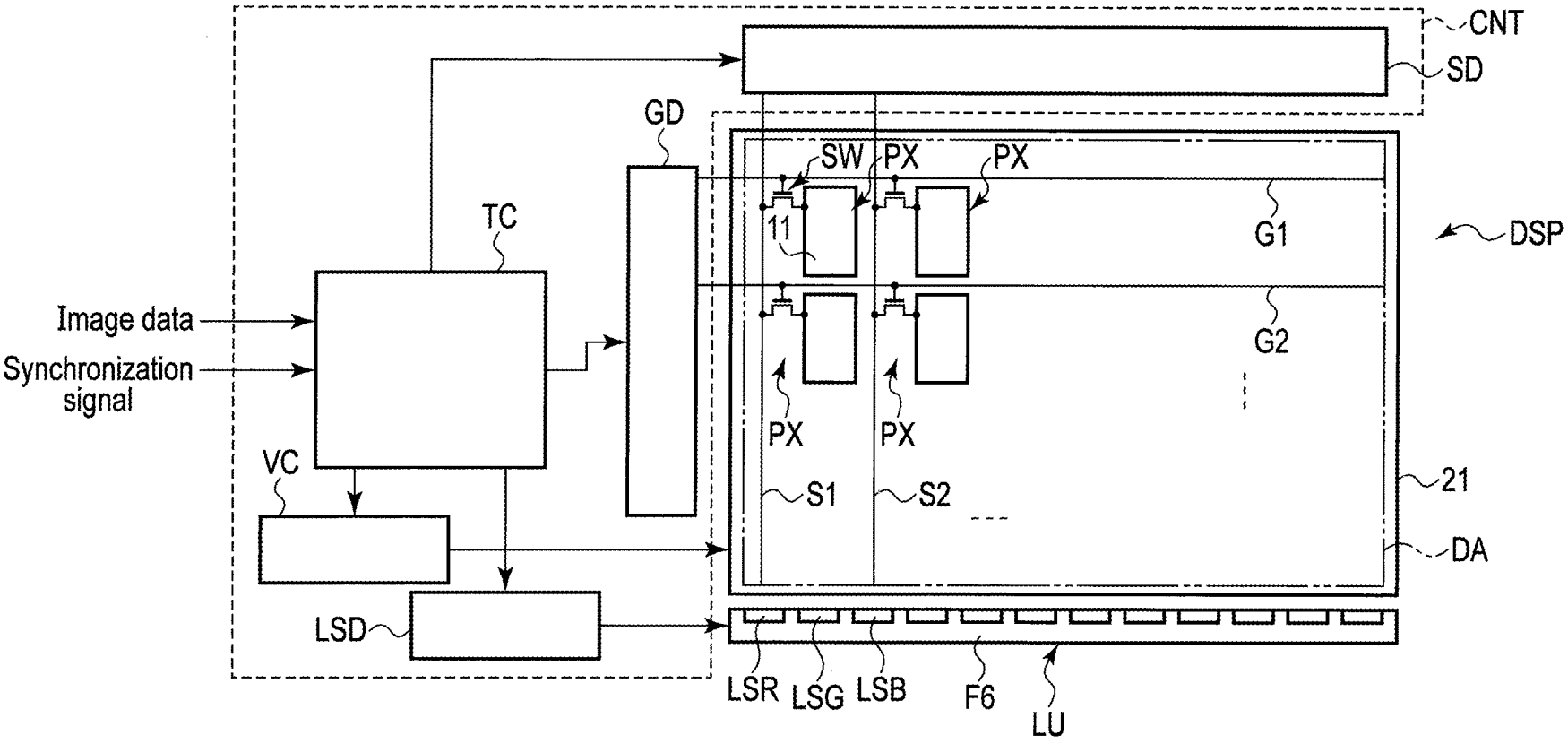
FIG. 3 is an illustration showing main constituent elements of the display device shown in FIG. 1.

FIG. 3 is an illustration showing main constituent elements of the display device DSP shown in FIG. 1.

As shown in FIG. 3, the display device DSP comprises a controller CNT indicated by a dashed line in the drawing. The controller CNT includes the timing controller TC, the gate driver GD, the source driver SD, a Vcom circuit VC, a light source driver LSD and the like.

The timing controller TC generates various signals based on image data, synchronization signals and the like which are input from the outside. For example, the timing controller TC outputs a video signal generated by predetermined signal processing based on image data to the source driver SD. In addition, the timing controller TC outputs controls signals generated bated on synchronization signals to the gate driver GD, the source driver SD, the Vcom circuit VC and the light source driver LSD, respectively. The details of the timing controller TC will be described later.

A plurality of pixels PX are located in the display area DA indicated by a two-dot chain line in the drawing. Each pixel PX comprises a switching element SW and a pixel electrode 11. The switching element SW is formed of, for example, a thin-film transistor. The switching element SW is electrically connected to the gate line G and the source line S. The pixel electrodes 11 are located in the display area DA and are provided in a matrix. Therefore, for example, the pixel electrodes 11 are arranged in rows. The pixel electrodes 11 are connected to the source lines S via the switching elements SW. The common electrode 21 is located in the display area DA. The common electrode 21 is opposed to the pixel electrodes 11. Note that, unlike in the present embodiment, the common electrode 21 may be divided by at least one pixel PX, connected to common lines and subjected to the same common voltage.

Gate signals are supplied from the gate driver GD to the gate lines G. Video signals (image signals) are supplied from the source driver SD to the source lines S. A common voltage Vcom is supplied from the Vcom circuit VC to the common electrode 21. A video signal supplied to a source line S is applied, in a period in which a switching element SW becomes electrically continuous based on a gate signal supplied to a gate line G, to a pixel electrode 11 connected to the switching element SW. In the following description, an operation of supplying a video signal to a pixel electrode 11 and thereby creating a potential difference between the pixel electrode 11 and the common electrode 21 may be described as an operation of writing a video signal (applying a voltage) to a pixel PX comprising the pixel electrode 11.

The light source unit LU is configured to emit light to the liquid crystal layer 30. In the present embodiment, the light source unit LU is configured to emit light having colors other than achromatic colors to the liquid crystal layer 30. The light source unit LU comprises a plurality of light-emitting elements LS of plural colors. For example, the light source unit LU comprises a light-emitting element (first light-emitting element) LSR which emits light having a first color to the liquid crystal layer 30, a light-emitting element (second light-emitting element) LSG which emits light having a second color to the liquid crystal layer 30 and a light-emitting element (third light-emitting element) LSB which emits light having a third color to the liquid crystal layer 30. Needless to say, the first, second and third colors are colors different from each other. In the present embodiment, the first color is red, the second color is green, and the third color is blue.

The light source driver LSD controls the lighting periods of the light-emitting elements LSR, LSG and LSB. As will be described later, in a drive method in which one frame period includes a plurality of sub-frame periods, at least one of three light-emitting elements LSR, LSG and LSB is turned on in each sub-frame and the color of illumination light is switched in each sub-frame.

A configuration example of the display device comprising the liquid crystal layer 30 which is a polymer dispersed liquid crystal layer will be described below.

Figure 4A:
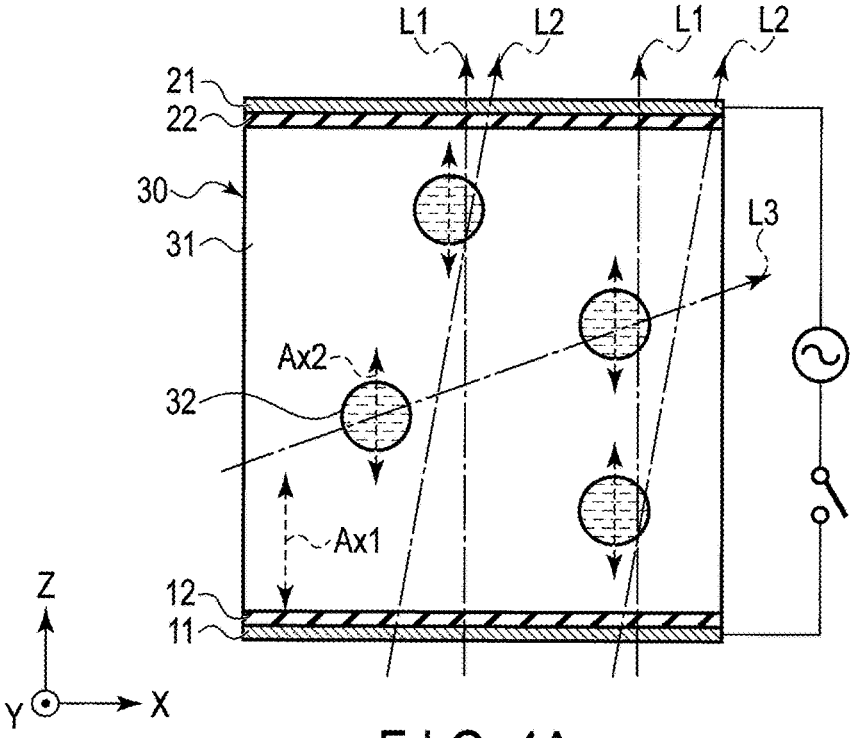
FIG. 4A is an illustration schematically showing a liquid crystal layer in a transparent state.

FIG. 4A is an illustration schematically showing the liquid crystal layer 30 in a transparent state.

As shown in FIG. 4A, the liquid crystal layer 30 contains liquid crystal polymers 31 and liquid crystal molecules 32. The liquid crystal polymers 31 are obtained by, for example, polymerizing liquid crystal monomers in a state of being aligned in a predetermined direction by the alignment restriction forces of the alignment films 12 and 22. The liquid crystal molecules 32, dispersed in the liquid crystal monomers, are aligned in a predetermined direction depending on the alignment direction of the liquid crystal monomer when the liquid crystal monomer is polymerized. The alignment films 12 and 22 may be horizontal alignment films which align the liquid crystal monomers and the liquid crystal molecules 32 along an X-Y plane defined by the first direction X and the second direction Y or may be vertical alignment films which align the liquid crystal monomers and the liquid crystal molecules 32 in the third direction Z.

The liquid crystal molecules 32 may be positive liquid crystal molecules with positive dielectric anisotropy or may be negative liquid crystal molecules with negative dielectric anisotropy. The liquid crystal polymers 31 and the liquid crystal molecules 32 exhibit equal optical anisotropy. Alternatively, the liquid crystal polymers 31 and the liquid crystal molecules 32 exhibit substantially equal refractive anisotropy. That is, the liquid crystal polymers 31 and the liquid crystal molecules 32 have substantially equal ordinary indexes and extraordinary indexes. In either of the ordinary and extraordinary indexes, the value of the liquid crystal polymers 31 and the value of the liquid crystal molecules 32 do not necessarily exactly match each other, and a deviation resulting from a manufacturing error or the like is within tolerance. Furthermore, the liquid crystal polymers 31 and the liquid crystal molecules 32 exhibit different responsivity to an electric field. That is, the responsivity to an electric field of the liquid crystal polymers 31 is lower than the responsivity to an electric field of the liquid crystal molecules 32.

The example shown in FIG. 4A corresponds to, for example, a state in which no voltage is applied to the liquid crystal layer 30 (a state in which a potential difference between the pixel electrode 11 and the common electrode 21 is zero) or a state in which a second transparent voltage which will be described later is applied to the liquid crystal layer 30.

As shown in FIG. 4A, an optical axis Ax1 of the liquid crystal polymer 31 and an optical axis Ax2 of the liquid crystal molecule 32 are parallel to each other. In the example illustrated, the optical axis Ax1 and the optical axis Ax2 are parallel to the third direction Z. The optical axis here corresponds to a line parallel to the travel direction of a light beam such that a refractive index has one value regardless of a polarization direction.

As described above, since the liquid crystal polymer 31 and the liquid crystal molecule 32 exhibit substantially equal refractive anisotropy and the optical axes Ax1 and Ax2 are parallel to each other, there is hardly any refractive index difference between the liquid crystal polymer 31 and the liquid crystal molecule 32 in all directions including the first direction X, the second direction Y and the third direction Z. Therefore, a light beam L1 which has entered the liquid crystal layer 30 in the third direction Z is transmitted almost without being scattered in the liquid crystal layer 30. The liquid crystal layer 30 can maintain the degree of parallelism of the light beam L1. Similarly, light beams L2 and L3 which have entered in oblique directions which are oblique with respect to the third direction Z are hardly scattered in the liquid crystal layer 30. For this reason, high transparency can be obtained. The state shown in FIG. 4A is referred to as a transparent state.

Figure 4B:
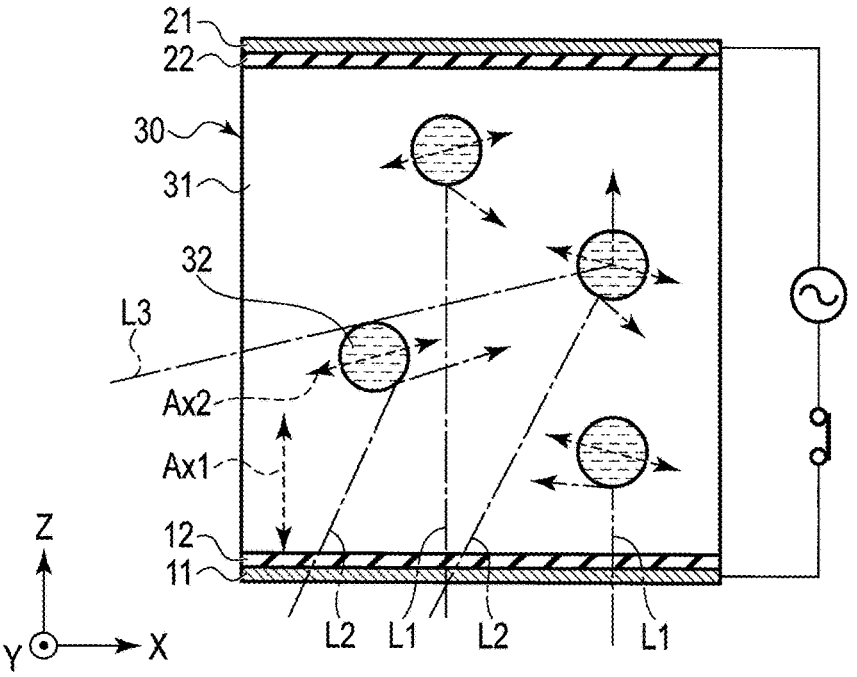
FIG. 4B is an illustration schematically showing the liquid crystal layer in a scattering state.

FIG. 4B is an illustration schematically showing the liquid crystal layer 30 in a scattering state.

As shown in FIG. 4B, the responsivity to an electric field of the liquid crystal polymer 31 is lower than the responsivity to an electric field of the liquid crystal molecule 32 as described above. Therefore, in a state in which a voltage (scattering voltage which will be described later) higher than each of the second transparent voltage described above and a first transparent voltage which will be described later is applied to the liquid crystal layer 30, the alignment direction of the liquid crystal polymer 31 hardly changes but the alignment direction of the liquid crystal molecule 32 changes according to an electric field. That is, as shown in the drawing, the optical axis Ax1 is substantially parallel to the third direction Z but the optical axis Ax2 is oblique with respect to the third direction Z. Accordingly, the optical axes Ax1 and Ax2 intersect each other. Therefore, there is a large refractive index difference between the liquid crystal polymer 31 and the liquid crystal molecule 32 in all directions including the first direction X, the second direction Y and the third direction Z. As a result, the light beams L1 to L3 which have entered the liquid crystal layer 30 are scattered in the liquid crystal layer 30. The state shown in FIG. 4B is referred to as a scattering state.

The control unit switches the liquid crystal layer 30 to at least one of the transparent state and the scattering state.

Figure 5A:
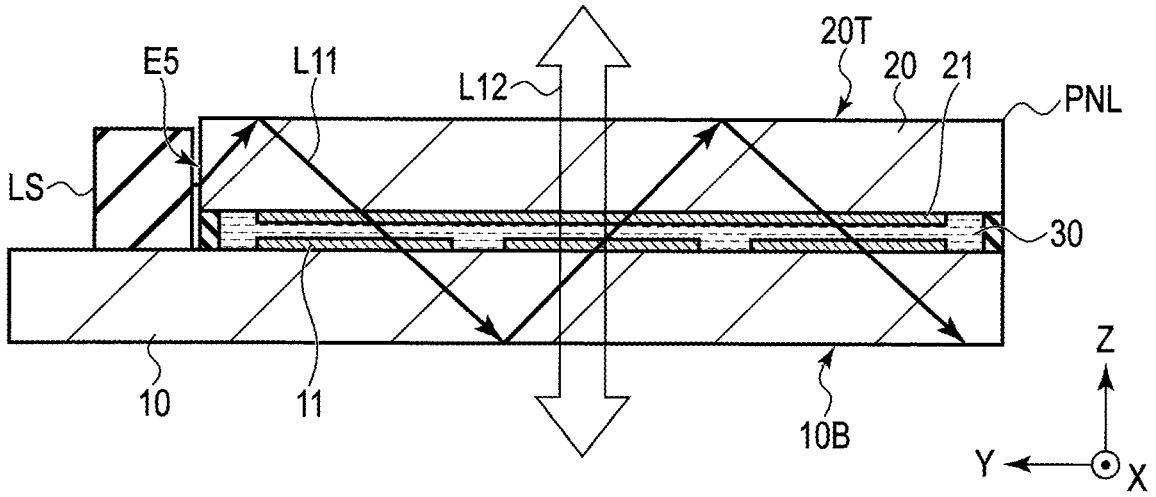
FIG. 5A is a cross-sectional view of a display panel in a case where the liquid crystal layer is in the transparent state.

FIG. 5A is a cross-sectional view showing the display panel PNL in a case where the liquid crystal layer 30 is in the transparent state. As shown in FIG. 5A, an illumination light beam L11 emitted from the light-emitting element LS enters the display panel PNL from the end portion E5 and propagates through the transparent substrate 20, the liquid crystal layer 30, the transparent substrate 10 and the like. When the liquid crystal layer 30 is in the transparent state, since the illumination light beam L11 is hardly scattered in the liquid crystal layer 30, the illumination light beam L11 hardly leaks from a lower surface 10B of the transparent substrate 10 and an upper surface 20T of the transparent substrate 20.

External light L12 entering the display panel PNL is transmitted almost without being scattered in the liquid crystal layer 30. That is, the external light which has entered the display panel PNL from the lower surface 10B is transmitted to the upper surface 20T, and the external light which has entered the display panel PNL from the upper surface 20T is transmitted to the lower surface 10B. Therefore, when the user observes the display panel PNL from the upper surface 20T side, the user can see the background on the lower surface 10B side through the display panel PNL. Similarly, when the user observes the display panel PNL from the lower surface 10B side, the user can see the background on the upper surface 20T side through the display panel PNL.

Figure 5B:
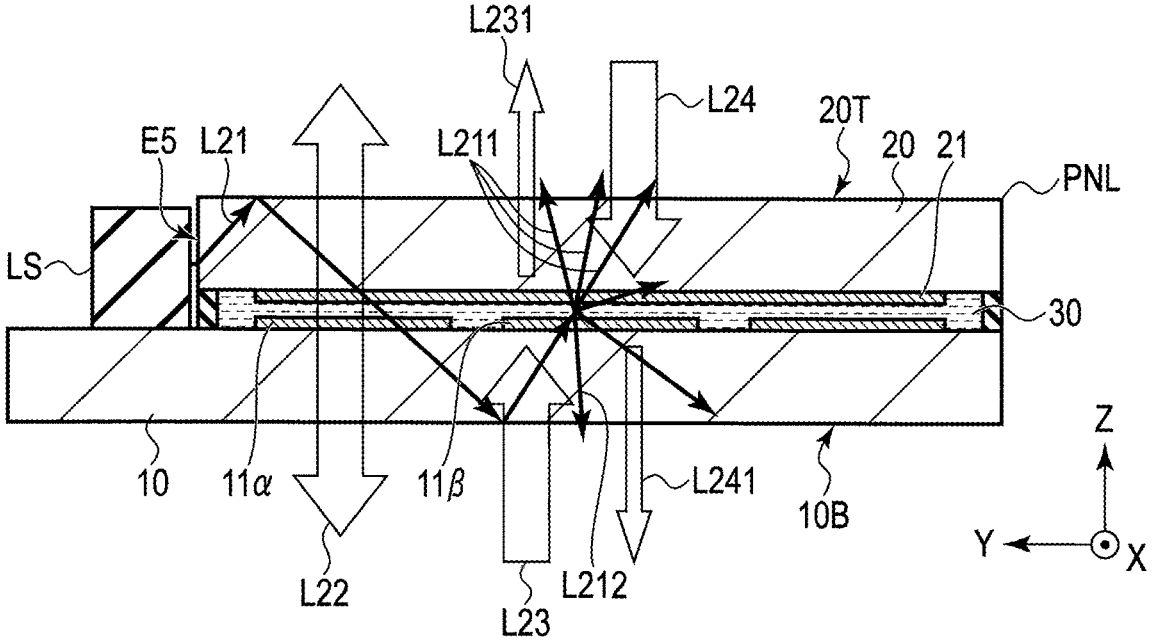
FIG. 5B is a cross-sectional view of the display panel in a case where the liquid crystal layer is in the scattering state.

FIG. 5B is a cross-sectional view showing the display panel PNL in a case where the liquid crystal layer 30 is in the scattering state. As shown in FIG. 5B, an illumination light beam L21 emitted from the light-emitting element LS enters the display panel PNL from the end portion E5 and propagates through the transparent substrate 20, the liquid crystal layer 30, the transparent substrate 10 and the like. In the example illustrated, the liquid crystal layer 30 between a pixel electrode 11α and the common electrode 21 (the liquid crystal layer to which a voltage applied between the pixel electrode 11α and the common electrode 21 is applied) is in the transparent state, and therefore the illumination light beam L21 is hardly scattered in an area of the liquid crystal layer 30 which is opposed to the pixel electrode 11α. On the other hand, the liquid crystal layer 30 between a pixel electrode 11p and the common electrode 21 (the liquid crystal layer to which a voltage applied between the pixel electrode 11(3 and the common electrode 21 is applied) is in the scattering state, and therefore the illumination light beam L21 is scattered in an area of the liquid crystal layer 30 which is opposed to the pixel electrode lip. Some scattered light beams L211 of the illumination light beam L21 are emitted to the outside from the upper surface 20T, and some scattered light beams L212 of the illumination light beam L21 are emitted to the outside from the lower surface 10E.

At a position overlapping the pixel electrode 11α, external light L22 entering the display panel PNL is transmitted almost without being scattered in the liquid crystal layer 30 as is the case with the external light L12 shown in FIG. 5A. At a position overlapping the pixel electrode 11β, part of external light L23 which has entered from the lower surface 10E, that is, light L231 is transmitted through the upper surface 20T after being scattered in the liquid crystal layer 30. In addition, part of external light L24 which has entered from the upper surface 20T, that is, light L241 is transmitted through the lower surface 10B after being scattered in the liquid crystal layer 30.

Therefore, when the user observes the display panel PNL from the upper surface 20T side, the user can see the color of the illumination light beam L21 at the position overlapping the pixel electrode 11β. In addition, since the light L231 which is part of the external light passes through the display panel PNL, the user can also see the background on the lower surface 10B side through the display panel PNL. Similarly, when the user observes the display panel PNL from the lower surface 10B side, the user can see the color of the illumination light beam L21 at the position overlapping the pixel electrode 11β. In addition, since the light L241 which is part of the external light passes through the display panel PNL, the user can also see the background on the upper surface 20T side through the display panel PNL. At the position overlapping the pixel electrode 11α, since the liquid crystal layer 30 is in the transparent state, the color of the illumination light beam L21 can hardly be seen and the background can be seen through the display panel PNL.

Figure 6:
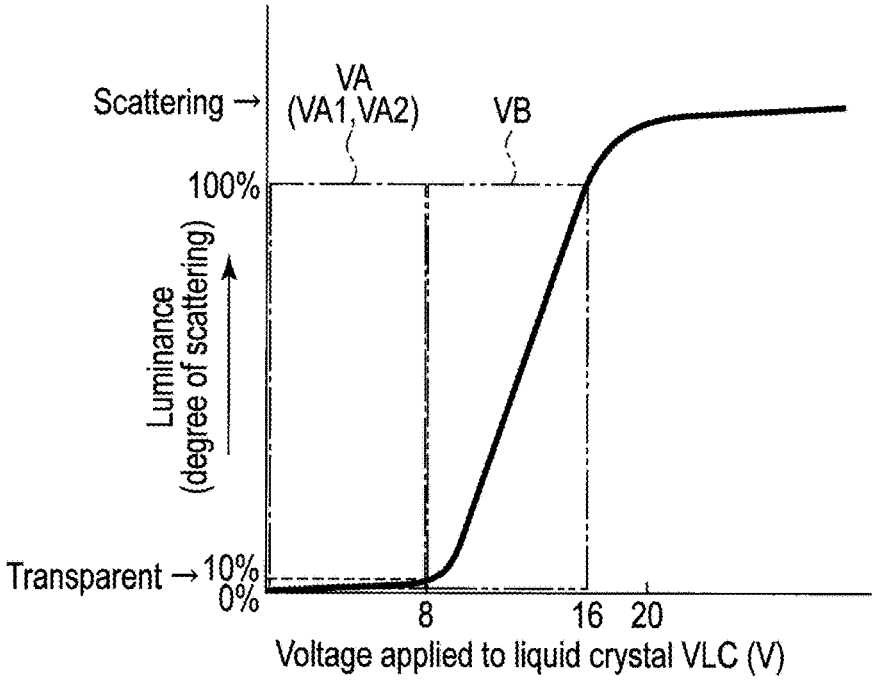
FIG. 6 is a graph showing the scattering characteristics of the liquid crystal layer.

FIG. 6 is a graph of the scattering characteristics of the liquid crystal layer 30 and shows the relationship between a voltage VLC applied to the liquid crystal layer 30 and a luminance. The luminance here corresponds to, for example, as shown in FIG. 5B, the luminance of the scattered light beams L211 which are obtained when the illumination light beam L21 emitted from the light-emitting element LS is scattered in the liquid crystal layer 30. From another perspective, the luminance represents the degree of scattering of the liquid crystal layer 30.

As shown in FIG. 6, when the voltage VLC is increased from 0 V, the luminance is sharply increased from about 8 V and is saturated at about 20 V. Note that the luminance is also slightly increased when the voltage VLC is in a range of 0 V to 8 V. In the present embodiment, a voltage in a region surrounded by a two-dot chain line, that is, in a range of 8 V to 16 V is used for gradation expression (for example, 256 gradation) of each pixel PX. A voltage in a range 8 V<VLC≤16 V is hereinafter referred to as a scattering voltage. Furthermore, in the present embodiment, a voltage in a region surrounded by a one-dot chain line, that is, in a range 0 V≤VLC≤8 V is referred to as a transparent voltage. The transparent voltage VA includes the above-described first transparent voltage VA1 and second transparent voltage VA2. Note that the lower limit and the upper limit of each of the scattering voltage VB and the transparent voltage VA are not limited to those of this example and may be appropriately determined according to the scattering characteristics of the liquid crystal layer 30.

Here, a degree of scattering in a case where the degree of scattering of incident light of the liquid crystal layer 30 becomes highest when the scattering voltage VB is applied to the liquid crystal layer 30 is assumed to be 100%. Here, the degree of scattering at a time when the scattering voltage VB of 16 V is applied to the liquid crystal layer 30 is assumed to be 100%. For example, the transparent voltage VA can be defined as a range of the voltage VLC in which the degree of scattering (luminance) becomes less than 10%. Alternatively, the transparent voltage VA can also be defined as the voltage VLC which is less than or equal to the voltage corresponding to the lowest gradation (8 V in the example shown in FIG. 6).

Furthermore, the transparent voltage VA (the first transparent voltage VA1 and the second transparent voltage VA2) may differ from that of the example shown in FIG. 6. For example, the above-described first transparent voltage VA1 may be a voltage in a range in which the degree of scattering is 10% or more but 50% or less. Furthermore, the above-described second transparent voltage VA2 may be a voltage in a range in which the degree of scattering is less than 10%.

The graph shown in FIG. 6 can be applied to both a case where the polarity of the voltage applied to the liquid crystal layer 30 is positive polarity (+) and a case where the polarity of the voltage applied to the liquid crystal layer 30 is negative polarity (−). The voltage VLC in the latter case has the absolute value of the voltage having negative polarity.

Figure 7A:
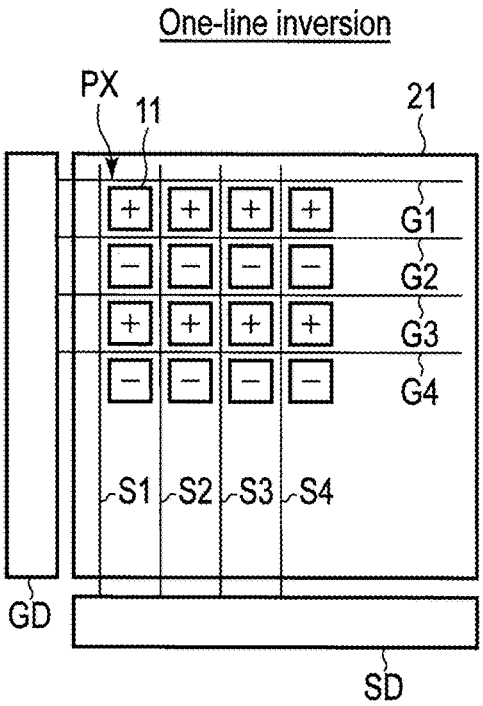
FIG. 7A is an illustration schematically showing one-line inversion drive.
Figure 7B:
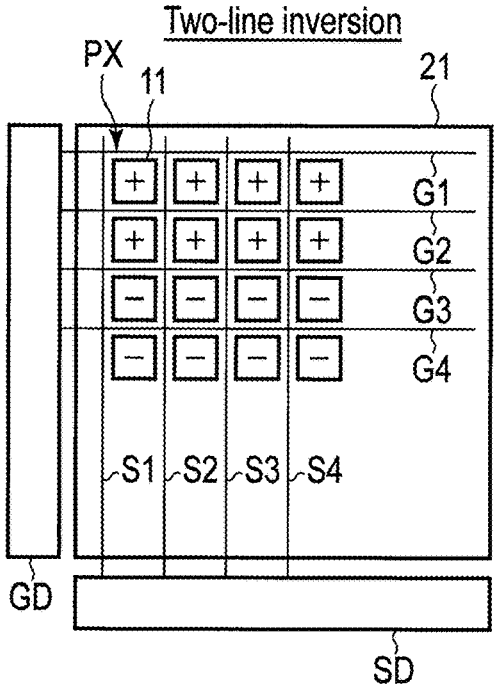
FIG. 7B is an illustration schematically showing two-line inversion drive.
Figure 7C:
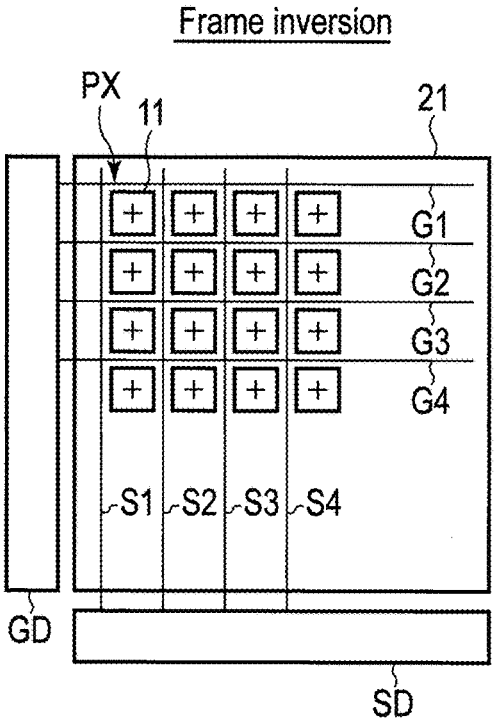
FIG. 7C is an illustration schematically showing frame inversion drive.

The display device DSP can employ polarity inversion drive in which the polarity of the voltage applied to the liquid crystal layer 30 is inverted. FIGS. 7A, 7B and 7C are illustrations schematically showing the polarity inversion drive.

FIG. 7A shows one-line inversion drive in which the voltage applied to the liquid crystal layer 30 (the voltage written to the pixels PX) is inverted between positive polarity (+) and negative polarity (−) in each group of pixels PX (one line) connected to one gate line G. In this drive method, for example, the polarity of the common voltage supplied to the common electrode 21 and the polarity of the video signal supplied from the source driver SD to the source lines S (the polarity of the source line voltage) are inverted in each horizontal period in which the gate driver GD supplies the gate signal to the gate lines G. In the same horizontal period, the polarity of the common voltage and the polarity of the video signal are, for example, opposite to each other.

FIG. 7B shows two-line inversion drive in which the voltage applied to the liquid crystal layer 30 is inverted between positive polarity (+) and negative polarity (−) in every two lines. The inversion drive is not limited to those of the examples of FIGS. 7A and 7B, and the polarity may be inverted in every three or more lines.

FIG. 7C shows frame inversion drive in which the voltage applied to the liquid crystal layer 30 is inverted between positive polarity (+) and negative polarity (−) in each frame period in which an image according to one image data is displayed. In this drive method, for example, the polarity of the common voltage and the polarity of the video signal are inverted in each frame period. In the same frame period, the polarity of the common voltage and the polarity of the video signal are, for example, opposite to each other.

Figure 8:
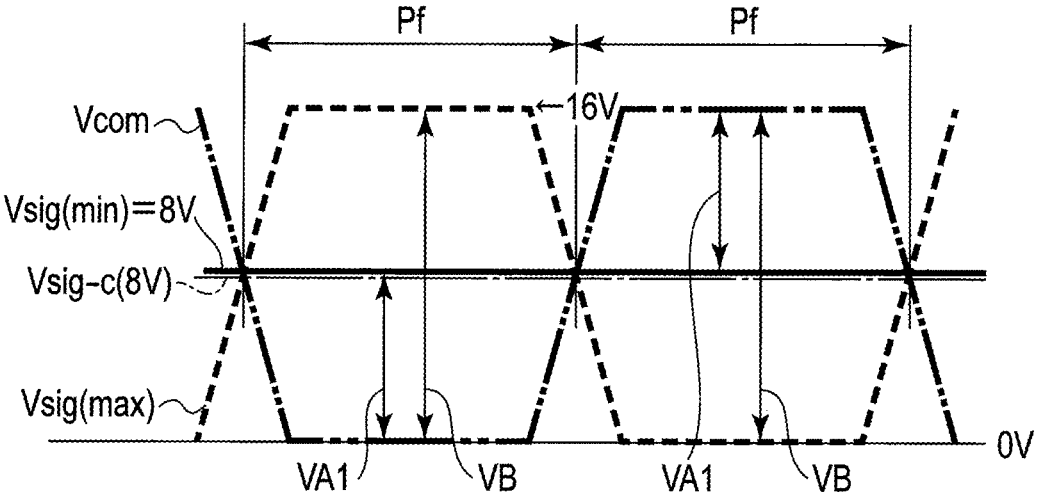
FIG. 8 is an illustration showing an example of a common voltage and a source line voltage in display drive.

FIG. 8 is an illustration showing an example of the common voltage Vcom supplied to the common electrode 21 and the source line voltage Vsig supplied to the source line S (or the pixel electrode 11) in display drive employing the one-line inversion drive shown in FIG. 7A.

As shown in FIG. 8, regarding the source line voltage Vsig, a waveform corresponding to the maximum value (max) of the gradation and a waveform corresponding to the minimum value (min) of the gradation are shown. The waveform of the source line voltage Vsig (min) is shown by a solid line, the waveform of the common voltage Vcom is shown by a two-dot chain line, and the waveform of the source line voltage Vsig (max) is shown by a dashed line. In the example of the drawing, the polarity of the common voltage Vcom and the polarity of the source line voltage Vsig (see the waveform of the maximum value) are inverted in each frame period Pf. A reference voltage Vsig-c is, for example, 8 V. In each of the common voltage Vcom and the source line voltage Vsig, the lower limit is 0 V and the upper limit is 16 V.

However, if the frame period Pf includes a plurality of sub-frame periods, the polarity of the common voltage Vcom and the polarity of the source line voltage Vsig may be inverted in each frame period Pf or may be inverted in each field period.

The polarity inversion drive is not limited to that of the example shown in FIG. 8, and when attention is focused on polarity inversion drive including an example shown in FIG. 9 which will be described later, if the drive voltage applied to the liquid crystal layer 30 (the voltage written to the pixels PX) has positive polarity, the difference between the source line voltage Vsig and the common voltage Vcom (Vsig−Vcom) is 0 V or has a positive voltage value. On the other hand, if the drive voltage applied to the liquid crystal layer 30 (the voltage written to the pixels PX) has negative polarity, the difference between the source line voltage Vsig and the common voltage Vcom (Vsig−Vcom) is 0 V or has a negative voltage value.

When attention is focused on the polarity inversion drive shown in FIG. 8, in a period in which a voltage having positive polarity is written to the pixels PX, the common voltage Vcom is 0 V and the source line voltage Vsig has a voltage value corresponding to a gradation indicated by image data in a range of 8 V or more to 16 V or less. On the other hand, in a period in which a voltage having negative polarity is written to the pixels PX, the common voltage Vcom is 16 V and the source line voltage Vsig has a voltage value corresponding to a gradation indicated by image data in a range of 0 V or more to 8 V or less. That is, in either case, a voltage of 8 V or more but 16 V or less is applied between the common voltage 21 and the pixel electrodes 11.

As shown in FIG. 6, even if the voltage VLC applied to the liquid crystal layer 30 is 8 V, in other words, even if the first transparent voltage VA1 is applied to the liquid crystal layer 30, the liquid crystal layer 30 still has a degree of scattering of 0 to 10%. Therefore, even if the source line voltage Vsig has the minimum value of the gradation, external light entering the display panel PNL is slightly scattered, and the visibility of the background of the display panel PNL may be reduced in some cases.

For this reason, as will be described above, the visibility of the background of the display panel PNL will be improved by introducing, into the sequence of image display, transparent drive (drive in a reset period which will be described later) in which the voltage between the pixel electrodes 11 and the common electrode 21 is, for example, lower than the lower limit of the gradation.

Now, the relationship between the output of the source driver SD and the common voltage Vcom will be described.

If the withstand voltage of the source driver SD is low, in order to increase the voltage applied to liquid crystal, inversion drive of the common voltage Vcom is executed. At this time, the source driver SD can only output either the source line voltage Vsig having positive polarity (for example, the reference voltage Vsig-c to 16 V) or the source line voltage Vsig having negative polarity (for example, 0 V to the reference voltage Vsig-c) simultaneously. In addition, the polarity of the common voltage Vcom is opposite to the polarity of the output of the source driver SD.

However, if the source driver SD having a high withstand voltage is used, the source line voltage Vsig and the common voltage Vcom may have the above-described relationship or may have the following relationship. That is, the common voltage Vcom is fixed to 0 V, while the source line voltage Vsig output from the source driver SD becomes 0 V to +16 V when it has positive polarity and becomes −16 V to 0 V when it has negative polarity.

Figure 9:
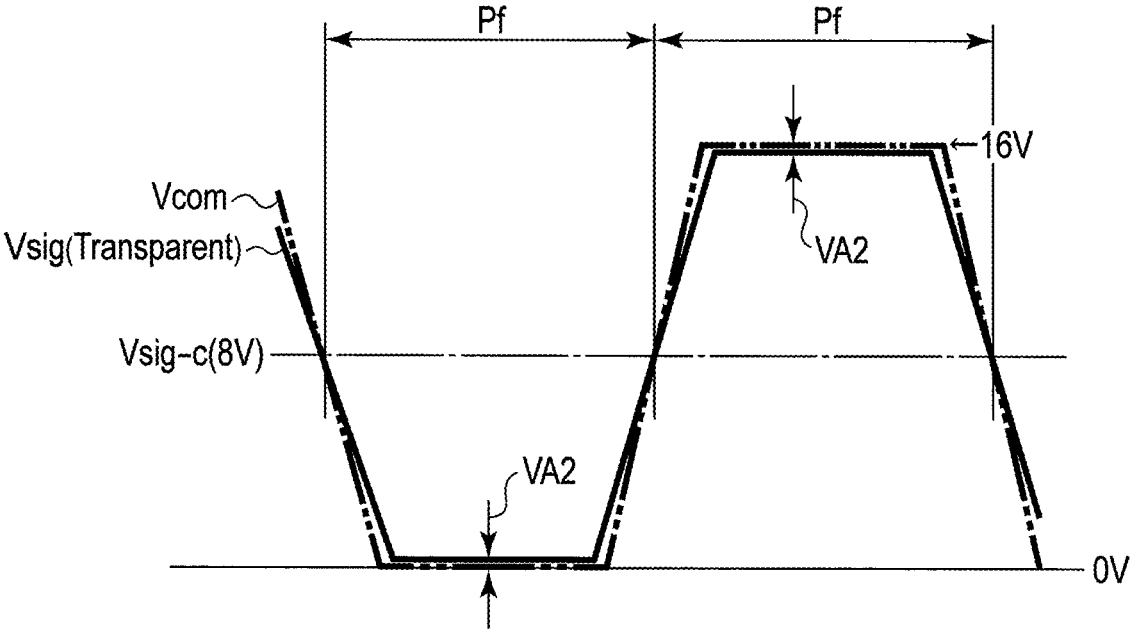
FIG. 9 is an illustration showing an example of a common voltage and a source line voltage in transparent drive.

FIG. 9 is an illustration showing an example of the common voltage Vcom and the source line voltage Vsig in the transparent drive. Here, the wavelength of the source line voltage Vsig is shown by a solid line and the waveform of the common voltage Vcom is shown by a two-dot chain line.

As shown in FIG. 9, the common voltage Vcom is changed alternately to 0 V and 16 V in each frame period Pf, similarly to the example shown in FIG. 8. In the transparent drive, the voltage value of the source line voltage Vsig matches the common voltage Vcom (Vsig=Vcom=0 V or Vsig=Vcom=16 V) in each frame period Pf. In FIG. 9, the source line voltage Vsig and the common voltage Vcom are slightly shifted from each other for illustration purposes. Accordingly, a voltage of 0 V is applied to the liquid crystal layer 30. In other words, the second transparent voltage VA2 is applied to the liquid crystal layer 30.

However, the source line voltage Vsig in the transparent drive is not limited to that of the example shown in FIG. 9. For example, the source line voltage Vsig may be greater than 0 V but less than 8 V (0 V<Vsig <8 V) in a period in which the common voltage Vcom becomes 0 V. The source line voltage Vsig may be greater than 8 V but less than 16 V (8 V<Vsig<16 V) in a period in which the common voltage Vcom becomes 16 V. In either case, according to the transparent drive, the absolute value of the difference between the source line voltage Vsig and the common voltage Vcom becomes less than 8 V, and the degree of parallelism of the light passing through the liquid crystal layer 30 increases. In other words, the second transparent voltage VA2 is not limited to 0 V, and the absolute value of the second transparent voltage VA2 may be less than 8 V.

In the transparent drive, only the voltage applied to the liquid crystal layer 30 needs to be less than the lower limit of the gradation (for example, 8 V), and the source line voltage Vsig does not need to completely match the common voltage Vcom. As described above, the degree of scattering in a case where the incident light of the liquid crystal layer 30 becomes highest when the scattering voltage VB is applied to the liquid crystal layer 30 is assumed to be 100%. For example, the second transparent voltage VA2 should preferably be a voltage at which the degree of scattering becomes less than 10%.

Figure 10:
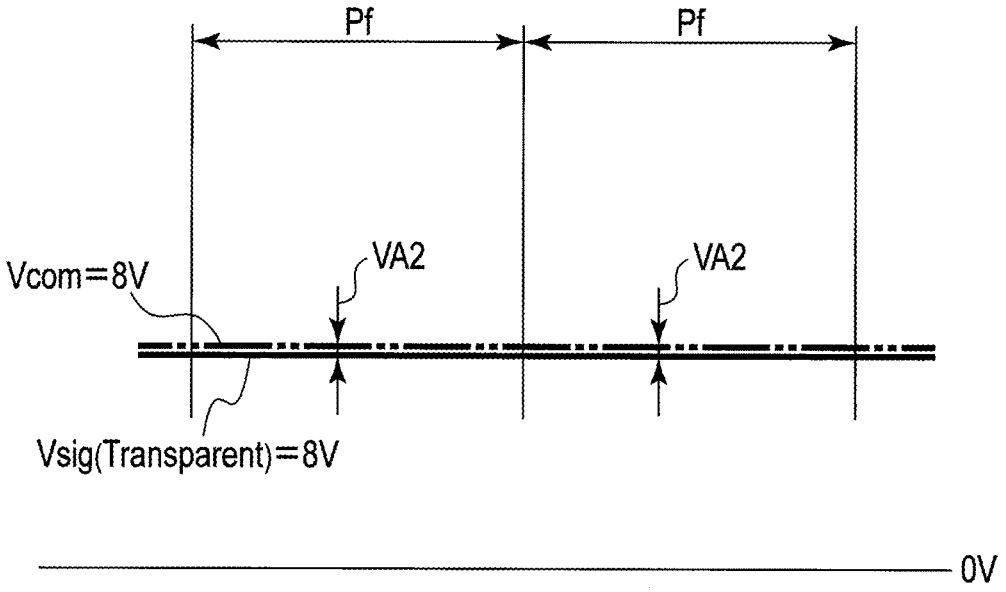
FIG. 10 is an illustration showing another example of the common voltage and the source line voltage in the transparent drive.

FIG. 10 is an illustration showing another example of the common voltage Vcom and the source line voltage Vsig in the transparent drive. Here, the wavelength of the source line voltage Vsig is shown by a solid line and the waveform of the common voltage Vcom is shown by a two-dot chain line.

As shown in FIG. 10, in this example, polarity inversion is stopped in the common voltage Vcom and the source line voltage Vsig in the transparent drive. Furthermore, the common voltage Vcom and the source line voltage Vsig match each other at 8 V (the above-described reference voltage Vsig-c). Note that the common voltage Vcom and the source line voltage Vsig may match each other at a voltage other than the reference voltage Vsig-c such as 0 V. In addition, the second transparent voltage VA2 should preferably be a voltage at which the degree of scattering becomes less than 10% as is the case with the example shown in FIG. 9.

The transparent drive has been described above by taking one-line inversion drive as an example. However, similar transparent drive can also be applied to line inversion drive for two or more lines or frame inversion drive.

Next, an example of the control of the display device DSP employing the transparent drive will be described with reference to FIGS. 11 to 15. A drive method in which one frame period includes a plurality of sub-frame (field) periods is applied to the display device DSP. This drive method is referred to as, for example, a field sequential method. In the sub-frame periods, red, green and blue images are displayed, respectively. The images of the respective colors displayed in a time-sharing manner are combined with each other and viewed as an image of multicolor display by the user.

Figure 11:
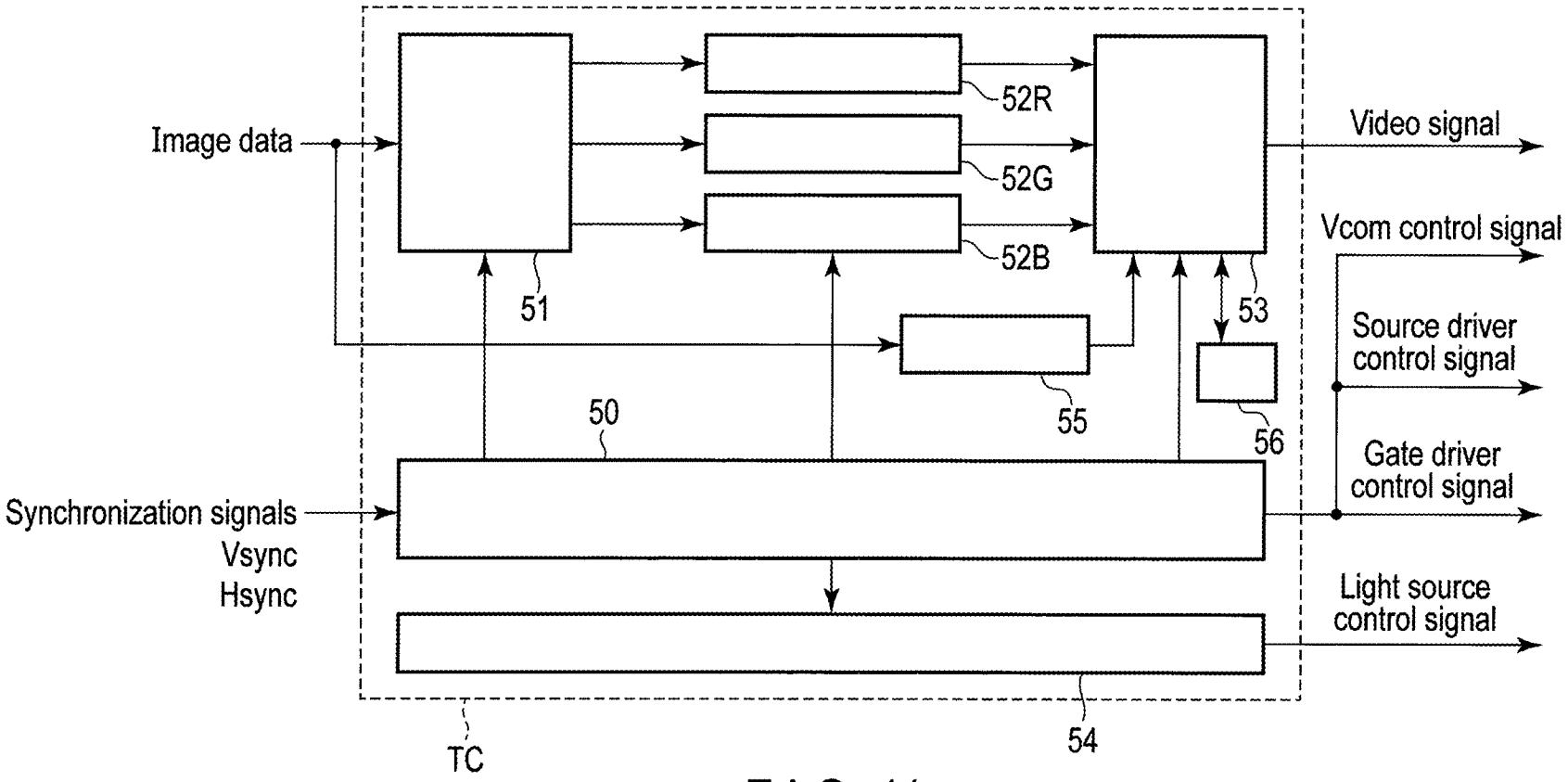
FIG. 11 is an illustration showing a configuration example of a timing controller shown in FIG. 3.

FIG. 11 is an illustration showing a configuration example of the timing controller TC shown in FIG. 3.

As shown in FIG. 11, the timing controller TC comprises a timing generation unit 50, a frame memory 51, line memories 52R, 52G and 52B, a data conversion unit 53, a light source control unit 54, a detection unit 55 which is an address detection unit, and the like.

The frame memory 51 stores image data for one frame which is input from the outside. The line memories 52R, 52G and 52B store sub-frame data for red, green and blue, respectively. The sub-frame data indicate red, green and blue images to be displayed in a time-sharing manner in each pixel PX (for example, gradation values of each pixel PX). The sub-frame data of the colors stored respectively in the line memories 52R, 52G and 52G correspond to the previous frame of the image data stored in the frame memory 51. The data conversion unit 53 generates video signals by executing various data conversion processes such as gamma correction for the sub-frame data of the colors stored respectively in the line memories 52R, 52G and 52B, and outputs them to the above-described source driver SD. Alternatively, the timing controller TC may be configured to sort into data of RGB in the frame memory 51 and transmit the data of RGB to the data conversion unit 53. In that case, it is possible to construct the timing controller TC without the line memories 52R, 52G and 52B.

The light source control unit 54 outputs light source control signals to the above-described light source driver LSD. The light source driver LSD drives the light-emitting elements LSR, LSG and LSB based on the light source control signals. The light-emitting elements LSR, LSG and LSB can be driven by, for example, pulse width modulation (PWM) control. That is, the light source driver LSD can control the luminances of the light-emitting elements LSR, LSG and LSB by the duty ratios of the signals output to the light-emitting elements LSR, LSG and LSB.

The timing generation unit 50 controls the operation timings of the frame memory 51, the line memories 52R, 52G and 52B, the data conversion unit 53 and the light source control unit 54 in synchronization with a vertical synchronization signal Vsync and a horizontal synchronization signal Hsync which are input from the outside. In addition, the timing generation unit 50 controls the source driver SD by outputting a source driver control signal and controls the gate driver GD by outputting a gate driver control signal, and outputs a Vcom control signal.

The detection unit 55 is configured, if data on an image is included in image data for one frame which is input from the outside, to detect the address of the data on the image. The above-described image is characters displayed in a part of the display area DA. The above-described characters may be symbols including letters, pictures, icons or the like. In addition, a case where data on characters are included in image data means a case where data other than 0 is included in at least one portion of the total bits of digital data. The address information on the data on the image is provided to the data conversion unit 53. For this reason, if data on an image is included in image data which is input from the outside, the timing controller TC generates processed video signals and outputs them to the source driver SD in order to control the degree of scattering (transparency) of the area other than the area on which the image is displayed. The timing controller TO generates processed video signals by executing calculation by the data conversion unit 53 or by using data stored in a table 56 of the timing controller TC.

An example of the control of the degree of scattering (transparency) of the area other than the area on which the image (characters) is displayed will be described here.

Figure 12:
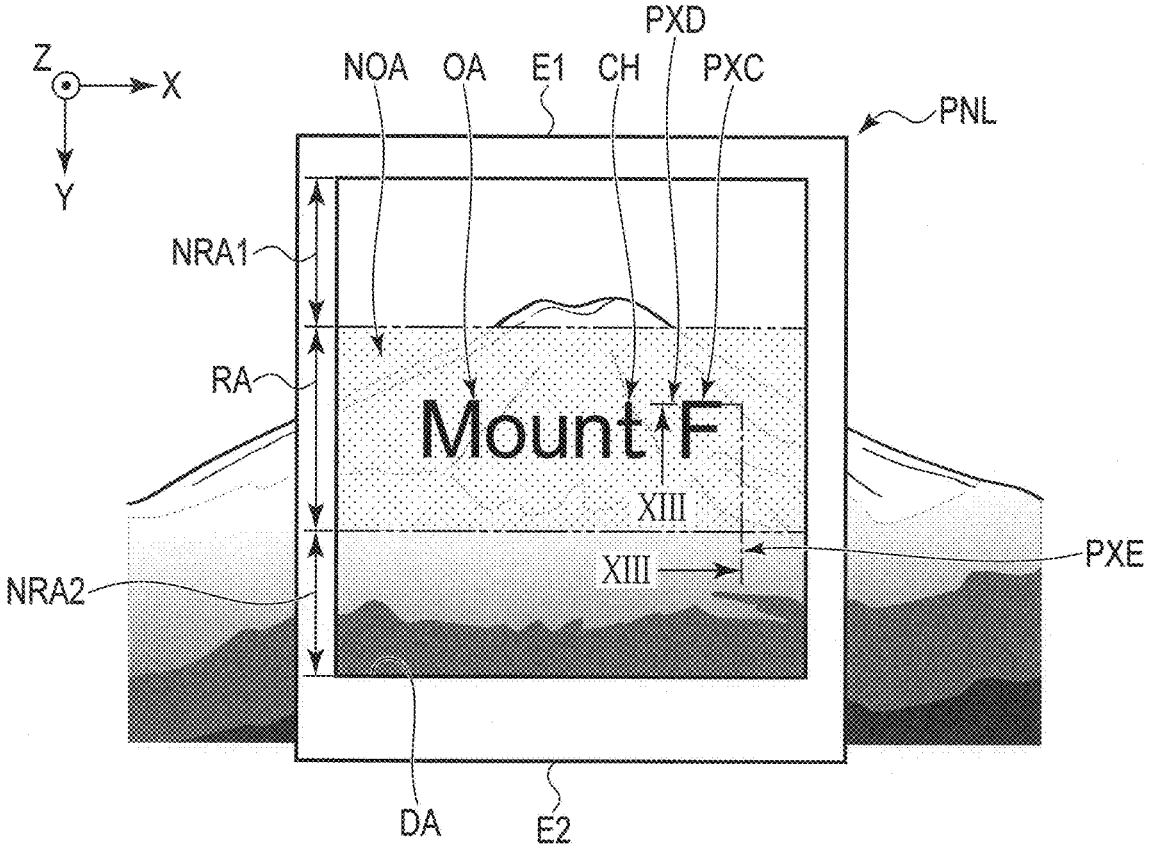
FIG. 12 is an illustration showing a usage example of the display device and a plan view showing the display panel in a state of displaying an image in a rewrite area.

As shown in FIG. 12, it is assumed that the user sees Mount F in the background through the display device DSP. In this case, if an image CH of a string of letters: "Mount F" is simply displayed in the display area DA, the image CH overlaps Mount F in the background, and the user may find it difficult to see (recognize) the image CH. Therefore, the present embodiment provides a technique of allowing the user to see the image CH more easily even when the image CH overlaps Mount F in the background. In other words, the present embodiment provides a technique of allowing the user to be less likely to be affected by the background.

An area of the display area DA on which the image CH is displayed is assumed to be an object area OA. In the present embodiment, the image CH is six letters spaced apart from each other, and the object area OA is a discontinuous area. An area of the display area DA which includes the entire area of rows in which at least the object area OA is located is assumed to be a rewrite area RA. In the present embodiment, the rewrite area RA includes not only the entire area of rows in which the object area OA is located but also the entire area of some rows on the end portion E1 side of the object area OA and the entire area of some rows on the end portion E2 side of the object area OA. Furthermore, the rewrite area RA is a center area in the second direction Y of the display area DA in this example. An area of the rewrite area RA other than the object area OA is assumed to be a non-object area NOA. The object area OA is an area corresponding to pixels to which the scattering voltage VB higher than or equal to the predetermined voltage of the gradation voltage is applied. The non-object area NOA is an area corresponding to pixels to which the first transparent voltage VA1 is applied. The above-described first transparent voltage VA1 is a voltage in a predetermined range close to a level at which the gradation expression of the gradation voltage can be executed. An area of the display area DA other than the rewrite area RA is assumed to be a non-rewrite area NRA. In this example, the display area DA has a non-rewrite area NRA1 on the end portion E1 side of the rewrite area RA and a non-rewrite area NRA2 on the end portion E2 side of the rewrite area RA. As described above, one of the scattering voltage VB and the first transparent voltage VA1 is applied to the pixels of the rewrite area RA, and the second transparent voltage VA2 is applied to the pixels of the non-rewrite areas NRA1 and NRA2.

Figure 13A:
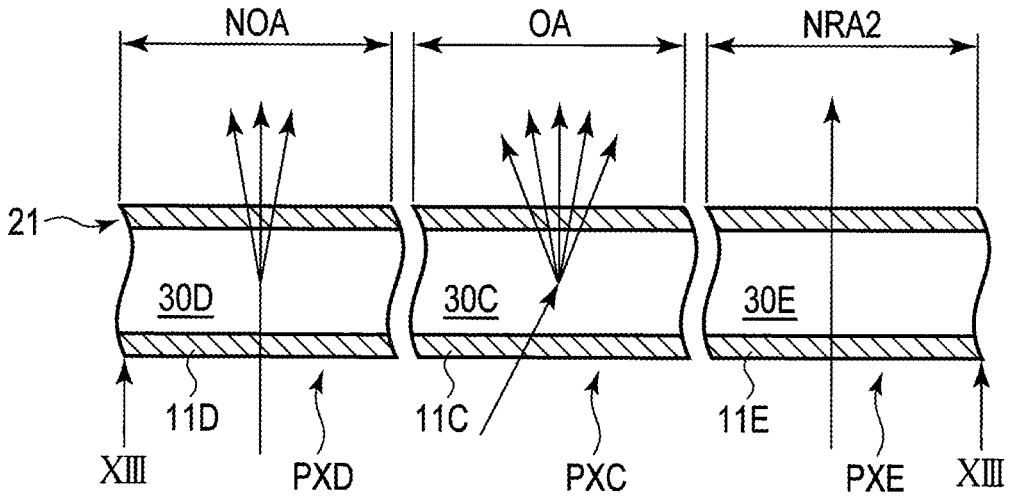
FIG. 13A is a cross-sectional view of the display panel taken along line XIII-XIII of FIG. 12.
Figure 13B:
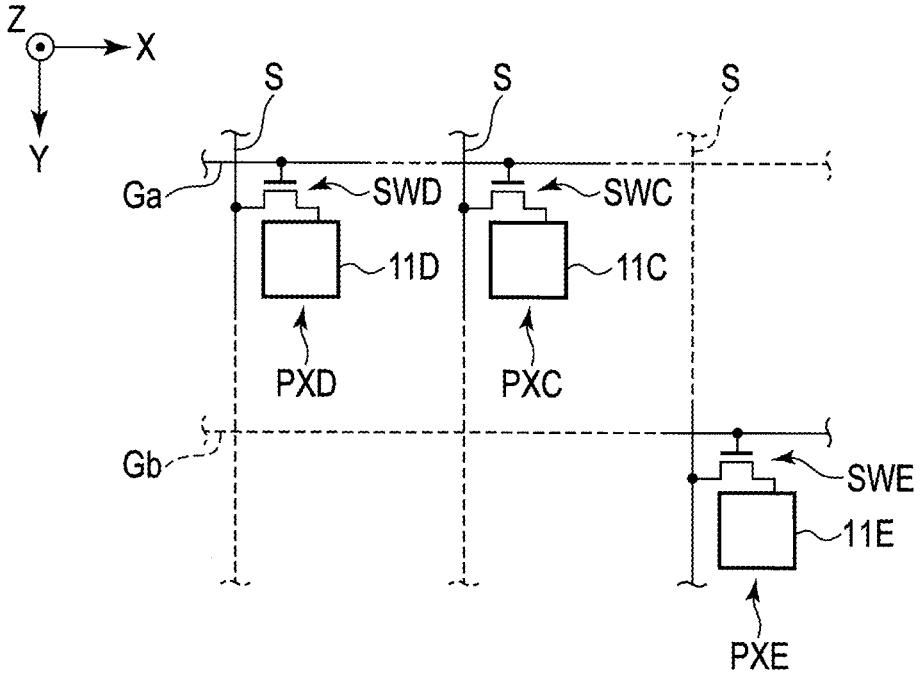
FIG. 13B is an equivalent circuit showing the relationship in connection between a plurality of pixel electrodes shown in FIG. 13A, a plurality of gate lines, a plurality of source lines and a plurality of switching elements.

FIG. 13A shows only a part of the display panel PNL which is necessary for explanation. In addition, FIG. 13A shows optical paths and also shows the way light is diffused in the liquid crystal layer 30 and the way the degree of parallelism of light is maintained in the liquid crystal layer 30. FIG. 13B shows the relationship in connection among the pixel electrodes 11 shown in FIG. 13A, the gate lines G, the source lines S and the switching elements SW.

As shown in FIGS. 13A and 13B, the pixel electrodes 11 include a first pixel electrode 11C located in the above-described object area OA, a second pixel electrode 11D located in the above-described non-object area NOA and a third pixel electrode 11E located in the above-described non-rewrite area NRA2 (NRA). The gate lines G for pixels PX located in the rewrite area RA are assumed to be first gate lines Ga here. In addition, the gate lines G for pixels PX located in the non-rewrite area NRA are assumed to be second gate lines Gb here.

Each of the first pixel electrode 11C and the second pixel electrode 11D is electrically connected to one corresponding first gate line Ga of the first gate lines Ga. For example, the first pixel electrode 11C and the second pixel electrode 11D are electrically connected to the same first gate line Ga. The third pixel electrode 11E is electrically connected to one corresponding second gate line Gb of the second gate lines Gb. In each switching element SW, a gate electrode is connected to one corresponding gate line G, one of a source electrode and a drain electrode is connected to one corresponding source line S, and the other one is connected to the corresponding pixel electrode 11.

The liquid crystal layer 30 (display function layer) includes a first liquid crystal layer 30C (first display function layer) subjected to a voltage applied between the first pixel electrode 11C and the common electrode 21, a second liquid crystal layer 30D (second display function layer) subjected to a voltage applied between the second pixel electrode 11D and the common electrode 21, and a third liquid crystal layer 30E (third display function layer) subjected to a voltage applied between the third pixel electrode 11E and the common electrode 21. In the present embodiment, the first liquid crystal layer 30C is sandwiched between the first pixel electrode 11C and the common electrode 21, the second liquid crystal layer 30D is sandwiched between the second pixel electrode 11D and the common electrode 21, and the third liquid crystal layer 30E is sandwiched between the third pixel electrode 11E and the common electrode 21.

The pixels PX include a first pixel PXC, a second pixel PXD and a third pixel PXE. The first pixel PXC includes a first switching element SWC, the first pixel electrode 11C connected to the first switching element SWC, the first liquid crystal layer 30C, and the like. The second pixel PXD includes a second switching element SWD, the second pixel electrode 11D connected to the second switching element SWD, the second liquid crystal layer 30D, and the like. The third pixel electrode PXE includes a third switching element SWE, the third pixel electrode 11E connected to the third switching element SWE, the third liquid crystal layer 30E, and the like.

The liquid crystal layer 30 (first liquid crystal layer 30C, second liquid crystal layer 30D and third liquid crystal layer 30E) scatters incident light in a case where the above-described scattering voltage VB is applied, maintains the degree of parallelism of incident light in a case where the first transparent voltage VA1 is applied, and maintains the degree of parallelism of incident light in a case where the second transparent voltage VA2 is applied.

The degree of parallelism of light passing through the liquid crystal layer 30 in a case where the second transparent voltage VA2 is applied is higher than the degree of parallelism of light passing through the liquid crystal layer 30 in a case where the first transparent voltage VA1 is applied. The degree of parallelism of light passing through the liquid crystal layer 30 in a case where the first transparent voltage VA1 is applied is higher than the degree of parallelism of light passing through the liquid crystal layer 30 in a case where the scattering voltage VB is applied.

In addition, the degree of scattering of light passing through the liquid crystal layer 30 in a case where the scattering voltage VB is applied is higher than the degree of scattering of light passing through the liquid crystal layer 30 in a case where the first transparent voltage VA1 is applied. The degree of scattering of light passing through the liquid crystal layer 30 in a case where the first transparent voltage VA1 is applied is higher than the degree of scattering of light passing through the liquid crystal layer 30 in a case where the second transparent voltage VA2 is applied.

As shown in FIGS. 12, 13A and 13B, when the image CH is to be displayed in the object area OA of the display area DA, the above-described control unit CON of the present embodiment displays the image CH in the object area OA, makes the non-object area NOA transparent, and makes the non-rewrite area NRA transparent. The degree of transparency of the non-rewrite area NRA is higher than the degree of transparency of the non-object area NOA. In the present embodiment, since the liquid crystal layer 30 employs reverse-mode polymer dispersed liquid crystal, the first transparent voltage VA1 becomes higher than the second transparent voltage VA2, and the scattering voltage VB is higher than the first transparent voltage VA1. However, if the liquid crystal layer 30 employs, unlike in the present embodiment, normal-mode polymer dispersed liquid crystal layer, the first transparent voltage VA1 becomes higher than the scattering voltage VB, and the second transparent voltage VA2 becomes higher than the first transparent voltage VA1.

Therefore, the above-described control unit applies the scattering voltage VB to the first liquid crystal layer 30C, applies the first transparent voltage VA1 to the second liquid crystal layer 30D, and applies the second transparent voltage VA2 to the third liquid crystal layer 30E. When attention is focused on one frame period in the period of display of the image CH in the object area OA, the control unit CON drives the light source unit LU to emit light to the liquid crystal layer 30, and while the light is being emitted to the liquid crystal layer 30, the control unit CON applies the scattering voltage VB to the first liquid crystal layer 30C, applies the first transparent voltage VA1 to the second liquid crystal layer 30D, and applies the second transparent voltage VA2 to the third liquid crystal layer 30E.

The color of the image CH (the color to be displayed in the object area OA) is based on the color produced by the light source unit LU. Therefore, the control unit CON can set the color of the image CH to a single color produced by the light source unit LU or a mixture of a plurality of colors produced by the light source unit LU. In addition, it is possible to display the entire image CH in a single color or display the image CH by changing the color from one portion to another.

The degree of scattering of the light beam of the first liquid crystal layer 30C is higher than the degrees of scattering of the light beams of each of the second liquid crystal layer 30D and the third liquid crystal layer 30E. The first liquid crystal layer 30C is in the scattering state. Therefore, when the background is viewed through the display panel PNL, the visibility of the background can be made lowest in the object area OA.

On the other hand, the degree of parallelism of the light beam passing through the third liquid crystal layer 30E is higher than the degree of parallelism of the light beam passing through each of the first liquid crystal layer 30C and the second liquid crystal layer 30D. The third liquid crystal layer 30E is in the second transparent state. Therefore, when the background is viewed through the display panel PNL, the visibility of the background is highest in the non-rewrite area NRA.

Furthermore, the second liquid crystal layer 30D is also in the first transparent state. However, the degree of scattering of the light beam passing through the second liquid crystal layer 30D is higher than the degree of scattering of the light beam passing through the third liquid crystal layer 30E. When the background is viewed through the display panel PNL, the background can be made blurry in the non-object area NOA and the visibility of the background in the non-object area NOA can be reduced, and therefore the user can see the image CH more easily.

Next, the gate driver GD of the present embodiment will be described.

Figure 14:
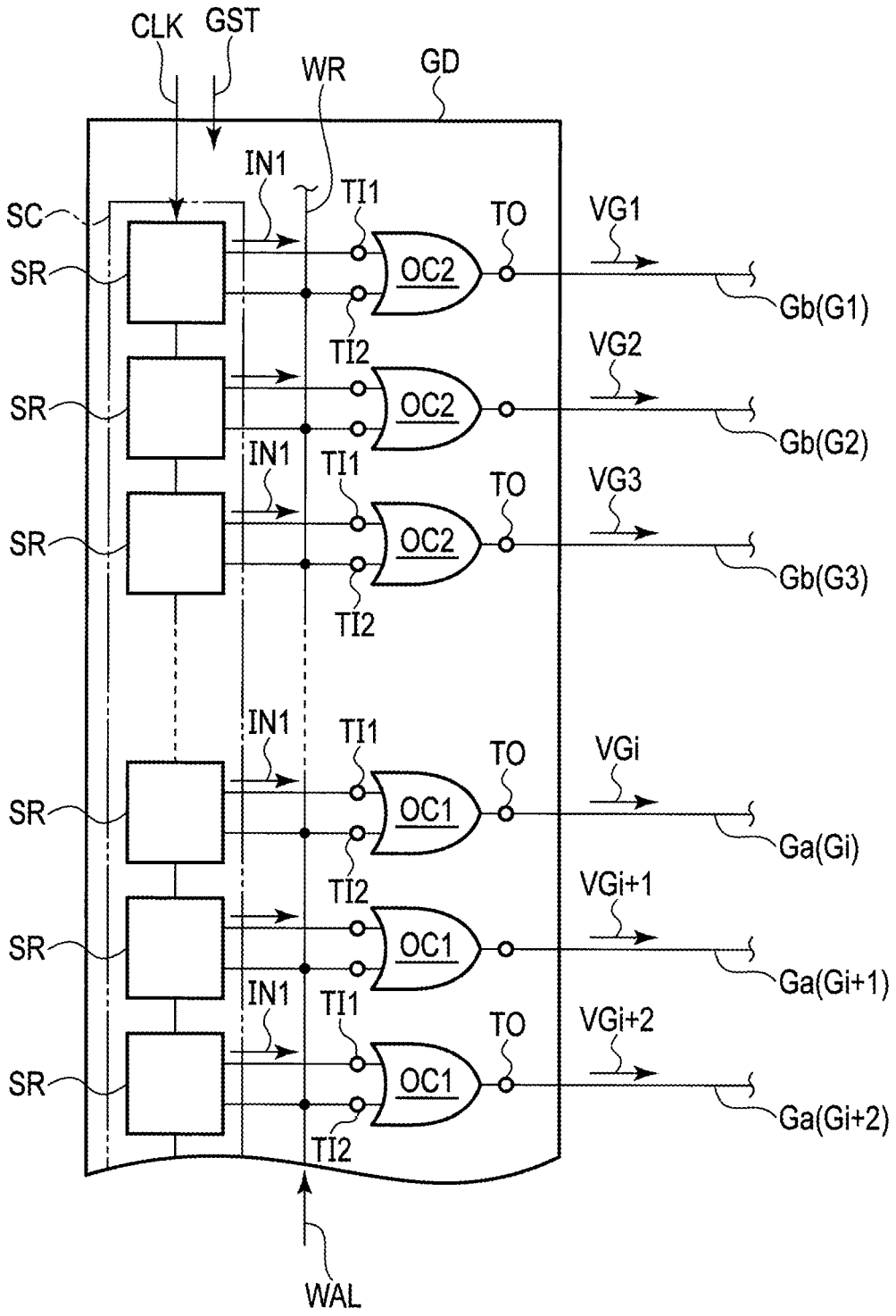
FIG. 14 is a circuit diagram showing a part of a gate driver shown in FIG. 3, etc., and some gate lines.

As shown in FIG. 14, the gate driver GD comprises a sequential circuit SC, a control wiring line WR and a plurality of logical sum circuits (OR circuits) OC. The sequential circuit SC includes a plurality of shift registers SR. The shift registers SR are connected in series.

The logical sum circuits OC are connected to the shift registers SR in a one-to-one relationship. Each logical sum circuit OC includes a first input terminal TI1, a second input terminal TI2 and an output terminal TO. The first input terminal TI1 is connected to the corresponding shift register SR. The second input terminal TI2 is connected to the control wiring line WR. The output terminal TO is connected to one corresponding gate line G.

When a high-level first input signal IN1 is supplied from the shift register SR to the first input terminal TI1, or when a high-level second input signal WAL is supplied from the control wiring line WR to the second input terminal TI2, the logical sum circuit OC outputs a first-level gate signal VG from the output terminal TO to the gate line G. If a low-level first input signal IN1 and a low-level second input signal WAL are simultaneously supplied, the logical sum circuit OC outputs a second-level gate signal VG from the output terminal TO to the gate line G. For example, the first level is a high level and the second level is a low level.

The logical sum circuits OC include a plurality of first logical sum circuits OC1 and a plurality of second logical sum circuits OC2. Each first logical sum circuit OC1 is connected to one corresponding first gate line Ga of the first gate lines Ga. Each second logical sum circuit OC2 is connected to one corresponding second gate line Gb of the second gate lines Gb.

As the control unit CON (for example, the timing controller TC) supplies the high-level second input signal WAL to the control wiring line WR, the gate driver GD simultaneously outputs the first-level gate signal VG to all the gate lines G. As a result, all the switching elements SW can be collectively turned on.

In another case, the control unit CON (for example, the timing controller TC) supplies the low-level second input signal WAL to the control wiring line WR. The sequential circuit SC sequentially supplies the high-level first input signal IN1 to the first input terminals TI1 of all the first logical sum circuits 0C1. The gate driver GD sequentially outputs the first-level gate signal VG to all the first gate lines Ga and turns on the first switching element SWC, the second switching element SWD and the like. Furthermore, the sequential circuit SC sequentially supplies the low-level first input signal IN1 to the first input terminals TI1 of all the second logical sum circuit OC2. The gate driver GD sequentially outputs the second-level gate signal VG to all the second gate lines Gb and turns off the third switching element SWE and the like.

In the above-described case, the gate driver GD can drive the second gate lines Gb at the second drive frequency higher than the first drive frequency at which the gate driver GD drives the first gate lines Ga.

In the present embodiment, the control unit CON supplies a gate clock signal GCK having the above-described first drive frequency and the above-described second drive frequency to the gate driver GD. The gate driver GD scans the gate lines G in synchronization with the gate clock signal GCK. Accordingly, the gate driver GD can scan the rewrite area RA and the non-rewrite area NRA at different drive frequencies based on the gate clock signal GCK.

Figure 15:
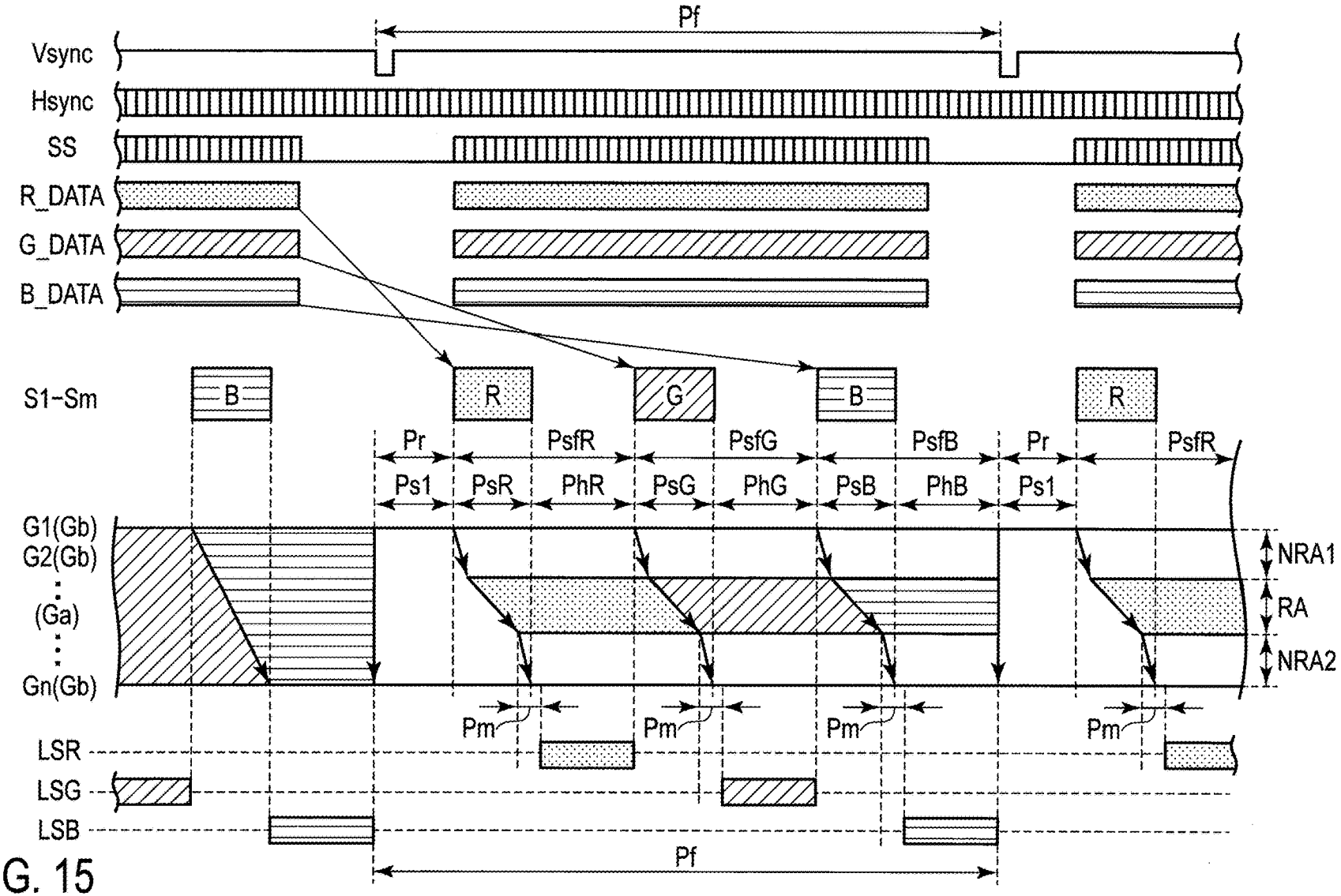
FIG. 15 is a timing chart showing an example of a display operation of the display device of the first embodiment.

FIG. 15 is a timing chart showing an example of the display operation of the display device DSP of the first embodiment.

As shown in FIG. 15, the vertical synchronization signal Vsync falls at the beginning of one frame. That is, in this example, a period of time from when the vertical synchronization signal Vsync falls to when the vertical synchronization signal Vsync falls again corresponds to the frame period (one frame period) Pf. For example, if the display device DSP is driven at 60 Hz, the frame period Pf is approximately 16.7 ms.

The frame period Pf includes a reset period Pr in which the above-described transparent drive is executed, a first sub-frame period PsfR, a second sub-frame period PsfG and a third sub-frame period PsfB. Each sub-frame period Psf corresponds to a period in which the above-described display drive is executed. In this example, the reset period Pr is a foremost period of the frame period Pf. The reset period Pr, the first sub-frame period PsfR, the second sub-frame period PsfG and the third sub-frame period PsfB come in this order. However, unlike in this example, the reset period Pr may not be a foremost period of the frame period Pf but may be a rearmost period of the frame period Pf.

In the reset period Pr, the transparent drive is executed under the control of the timing controller TC. That is, the gate driver GD simultaneously supplies the first-level gate signal VG to each of the gate lines G1 to Gn. For example, it is possible to execute by supplying the high-level second input signal WAL to the control wiring line WR. Furthermore, while the gate driver GD is supplying the gate signal VG, the source driver SD applies, for example, the source signal voltage Vsig having the same value as the common voltage Vcom to each of the source lines S1 to Sm. By this operation, the second transparent voltage VA2 is written between the pixel electrodes 11 of all the pixels PX and the common electrode 21. After the gate signal VG is supplied to the corresponding gate line G, the pixel electrode 11 of each pixel PX is electrically floating state until the gate signal VG is supplied to the next gate line G. Therefore, in the pixel PX to which the second transparent voltage VA2 is written, the transparent voltage VA2 is held until the next gate signal VG is supplied to the corresponding gate line G.

In the pixel PX to which the second transparent voltage VA2 is written, since the liquid crystal layer 30 is in the excellent second transparent state, the visibility of the background of the display panel PNL increases. In the present embodiment, all the light-emitting elements LSR, LSG and LSB are off in the reset period Pr. Although the light-emitting elements LSR, LSG and LSB should preferably be off in the resent period Pr, the light-emitting elements LSR, LSG and LSB may be on in the reset period Pr.

The source line voltage Vsig supplied to each of the source lines S1 to Sm in the reset period Pr does not necessarily have the same value as the common voltage Vcom as long as the voltage written to each pixel PX becomes the second transparent voltage VA2. The common voltage Vcom and the source line voltage Vsig in the transparent drive can take various forms described with reference to FIGS. 9 and 10.

A period in the reset period Pr in which the first-level gate signal VG is collectively supplied to all the gate lines G1 to Gn is a drive period Ps1. For example, the length of the drive period Psi is the length of the period of scanning of 5 to 10 gate lines G. By securing the drive period Ps1 for a certain period of time as described above, it is possible to allow the potential of the pixel electrodes 11 and the potential of the common electrode 21 to transition to desired values. Furthermore, in the example illustrated, since the first sub-frame period PsfR comes immediately after the drive period Ps1, Pr1=Ps1 in terms of a period of time. The reset period Pr may further include a hold period to hold the second transparent voltage VA2 after the drive period Ps1.

The first sub-frame period PsfR, the second sub-frame period PsfG and the third sub-frame period PsfB come in this order, but unlike in this example, these sub-frame periods Psf may come in a different order. In each sub-frame period Psf, the timing generation unit 50 executes display drive of the respective colors by controlling the frame memory 51, the line memories 52R, 52G and 52B and the data conversion unit 53 by a data synchronization signal SS or by using the detection unit 55 and the table 56.

The first sub-frame period PsfR includes a drive period PsR and a hold period PhR. In the drive period PsR, the gate driver GD sequentially supplies the gate signal VG to each of the gate lines G1 to Gn. At this time, the high-level gate signal VG is sequentially supplied to the first gate lines Ga, and the first gate lines Ga are driven at the first drive frequency. On the other hand, the low-level gate signal VG is sequentially supplied to the second gate lines Gb, and the second gate lines Gb are driven at the second drive frequency.

Furthermore, while the gate driver GD is supplying the gate signal, the source driver SD supplies the source line voltage Vsig according to sub-frame data for red (R_DATA) stored in the line memory 52R to each of the source lines S1 to Sm. More specifically, an operation of supplying the source line voltage Vsig of the gradation corresponding to each pixel PX of a line to which the gate signal is supplied collectively to each of the source lines S1 to Sm is repeated. The source line voltage Vsig is supplied to the pixel electrodes 11 of the pixels PX corresponding to the selected gate line G via the switching elements SW, and as the switching elements SW are switched to a non-continuous state, the potentials of the pixel electrodes 11 are held. Subsequently, a gate line G in the next row is selected and a similar drive operation is sequentially executed. However, the source line voltage Vsig applied to the second pixel PXD located in the non-object area NOA is the reference voltage Vsig-c and is adjusted to, for example, 8 V (FIG. 8).

By this operation, the voltage according to the sub-frame data for red is written between the pixel electrode 11 of each pixel PX and the common electrode 21. In each sub-frame period Psf, the source line voltage Vsig supplied to each pixel electrode 11 via each of the source lines S1 to Sm corresponds to either a voltage having different polarity from the common voltage Vcom of the common electrode 21 or the reference voltage Vsig-c. Therefore, the absolute value of the voltage written to each pixel PX of the rewrite area RA is 8 V or more but 16 V or less.

The hold period PhR is a period from when the write operations of all the pixels PX are completed until the second sub-frame period PsfG comes. In this hold period PhR, the light-emitting element LSR emits red light. When the light-emitting element LSR is to be turned on, a margin period Pm is interposed after the write operations of all the pixels PX of the rewrite area RA are completed and before the light-emitting element LSR is turned on. When the light-emitting element LSR is to be turned on, the margin period Pm is not necessarily interposed but the margin period Pm should preferably be interposed. With the margin period Pm, for example, the response period of liquid crystal can be secured. As a result, a red image is displayed in the display area DA.

The operations in the second sub-frame period PsfG and the third sub-frame period PsfB are similar to the operation in the first sub-frame period PsfR. That is, the second sub-frame period PsfG includes a drive period PsG and a hold period PhG, and a voltage according to sub-frame data for green (G_DATA) stored in the line memory 52G is written to the pixels PX of the rewrite area RA in the drive period PsG. At this time, a state in which the second transparent voltage VA2 is applied to the pixels PX of the non-rewrite area NRA is held, the scattering voltage VB is applied to the pixels PX of the object area OA, and the first transparent voltage VA1 is applied to the pixels of the non-object area NOA. In the hold period PhG, the light-emitting element LSG emits green light. As a result, a green image is displayed in the display area DA.

In addition, the third sub-frame period PsfB includes a drive period PsB and a hold period PhB, a voltage according to sub-frame data for blue (B_DATA) stored in the line memory 52B is written to the pixels PX of the rewrite area RA in the drive period PsB, and the light-emitting element LSB emits blue light in the hold period PhB. As a result, a blue image is displayed in the display area DA.

In a certain frame period Pf, image data to be displayed in the next frame period Pf is written to the frame memory 51. Furthermore, sub-frame data of the line memories 52R, 52G and 52B which have already been written to the pixels PX are rewritten with sub-frame data corresponding to the image data written in the frame memory 51, respectively.

The red, green and blue images displayed in a time-sharing manner in the first sub-frame period PsfR, the second sub-frame period PsfG and the third sub-frame period PsfB are mixed with each other and are viewed as the image CH of multicolor display by the user. In addition, in the reset period Pr, the second transparent voltage VA2 is applied between the pixel electrode 11 of each pixel PX and the common electrode 21. By setting the reset period Pr once every frame period Pf, the transparency of the display area DA increases and the visibility of the background of the display area DA improves. As described above, the reset period Pr may be set once every few frame periods Pf. Instead, the reset period Pr and one sub-frame period Psf may be alternately set. Alternatively, the reset period Pr and some sub-frame periods Psf may be alternately set. For the suppression of display failure such as image burn-in, the reset should preferably be set with high frequency.

For the adjustment of the resent period Pr, consideration may be give not only to the period of time until the potential of the pixel electrodes 11 and the potential of the common electrode 21 transition to desired values described above but also to the transparency of the display area DA.

As the ratio of the reset period Pr to the frame period Pf is higher, the transparency of the display area DA becomes higher but the visibility of the image may become lower. On this account, the length of the reset period Pr should preferably be, for example, less than or equal to ½ of the length of one frame period Pf. However, when importance is placed on transparency or the like, it is possible to increase the ratio of the reset period Pr to the frame period Pf. The first sub-frame period PsfR, the second sub-frame period PsfG and the third sub-frame period PsfB may have, for example, the same length. It is possible to adjust the chromaticity of a display image by changing the ratios of the first sub-frame period PsfR, the second sub-frame period PsfG and the third sub-frame period PsfB.

Next, the display operation of one frame period in a case where the image CH is displayed as shown in FIG. 12 by the display operation shown in FIG. 15 will be described.

As shown in FIGS. 12, 13A, 13B and 15, the above-described control unit CON applies the second transparent voltage VA2 to each of the first liquid crystal layer 30C, the second liquid crystal layer 30D and the third liquid crystal layer 30E in the reset period Pr and switches the light source unit LU to an off state of not emitting light to the liquid crystal layer 30. The control unit CON applies the first transparent voltage VA1 to the second liquid crystal layer 30D and holds a state in which the second transparent voltage VA2 is applied to the third liquid crystal layer 30E, in all the first sub-frame period PsfR, the second sub-frame period PsfG and the third sub-frame period PsfB. The control unit CON applies the scattering voltage VB to the first liquid crystal layer 30C in one or more sub-frame periods of the first sub-frame period PsfR, the second sub-frame period PsfG and the third sub-frame period PsfB.

A case where polarity inversion drive is applied to the above-described display operation will be described here.

As shown in FIGS. 12, 13A, 13B and 15, the scattering voltage VB includes a positive-polarity scattering voltage and a negative-polarity scattering voltage (FIG. 8). The positive-polarity scattering voltage is, for example, 8 V to 16 V and the negative-polarity scattering voltage is, for example, −16 V to −8 V. When the image CH is to be displayed in the object area OA, the control unit CON alternately applies the positive-polarity scattering voltage VB and the negative-polarity scattering voltage VB to the first liquid crystal layer 30C in each frame period Pf. At this time, the control unit CON alternately applies the positive-polarity first transparent voltage VA1 and the negative-polarity first transparent voltage VA1 to the second liquid crystal layer 30D in each frame period Pf. At this time, the control unit CON applies the second transparent voltage VA2 to the second liquid crystal layer 30D in each frame period Pf.

The absolute value of the positive-polarity first transparent voltage VA1 and the absolute value the negative-polarity first transparent voltage VA1 are half the maximum value of the positive-polarity scattering voltage VB and half the maximum value of the absolute value of the negative-polarity scattering voltage VB, respectively. For example, in the example shown in FIG. 8, the absolute value of the positive-polarity first transparent voltage VA1 and the absolute value of the negative-polarity first transparent voltage VA1 are 8 V, and the maximum value of the positive-polarity scattering voltage VB and the maximum value of the absolute value of the negative-polarity scattering voltage VB are 16 V. For example, regardless of the polarity of the first transparent voltage VA1 and the polarity of the scattering voltage VB, the absolute value of the first transparent voltage VA1 is half the maximum value of the absolute value of the scattering voltage VB. However, the positive-polarity first transparent voltage VA1 and the negative-polarity first transparent voltage VA1 are not limited to those of the above-described example but may be any voltages in a range in which the degree of scattering becomes less than or equal to 50%.

Next, the relationship between a second input signal WAL, a gate start pulse signal GST, a gate clock signal GCK, gate signals VG1, VG2, VGi, VGi+1, VGi+2, VGn−1 and VGn, and potentials V11 (1, j) and V11 (i, j) of pixel electrodes 11 will be described.

Figure 16:
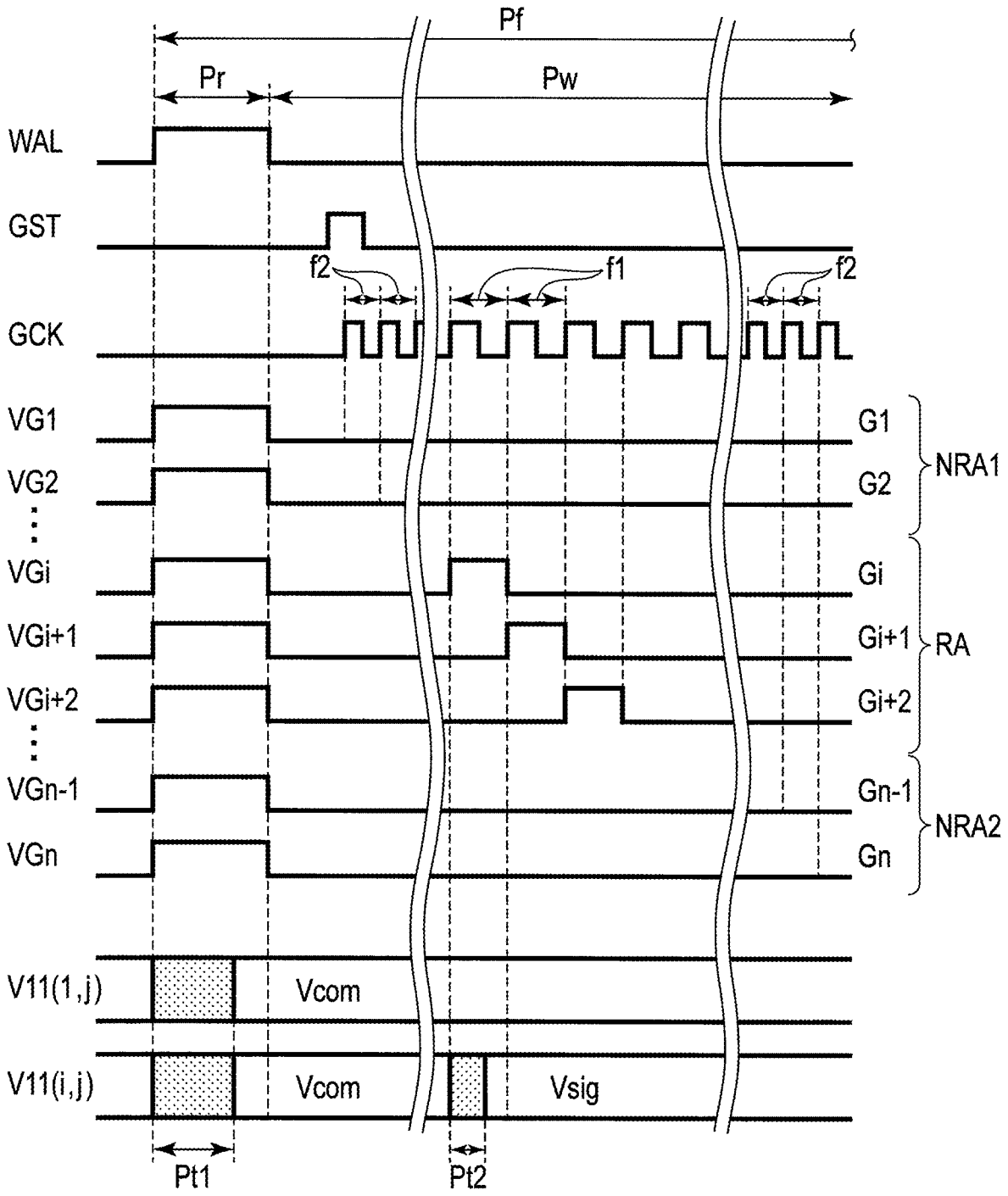
FIG. 16 is a timing chart showing a second input signal, a gate start pulse signal, a gate clock signal, gate signals and the potentials of pixel electrodes.

As shown in FIGS. 16, 3 and 14, in the reset period Pr, the level of the second input signal WAL switches to a high level and the gate driver GD outputs a first-level (here, high-level) gate signal VG to all the gate lines G. As a result, all the switching elements SW are turned on. The source driver SD applies a common voltage Vcom to all the source lines S. As a result, the common voltage Vcom is written to all the pixel electrodes 11. After a transition period Pt1 passes, the potentials V11 of the pixel electrodes 11 become the same as the potential of the common electrode 21. For example, the potential V11 (1, j) of the pixel electrode 11 (1, j) in row 1 and column j and the potential V11 (i, j) of the pixel electrode 11 (i, j) in row i and column j are determined after the transition period Pt1 passes. Note that the pixel electrode 11 (1, j) corresponds to the above-described third pixel electrode 11E, and the pixel electrode 11 (i, j) corresponds to either the above-described first pixel electrode 11C or the above-described second pixel electrode 11D.

The rewrite period Pw is a period following after the reset period Pr and is, for example, the above-described sub-frame period PsfR. In the rewrite period Pw, the level of the gate start pulse signal GST input to the gate driver GD switches to a high level. Subsequently, the gate driver GD starts importing the gate clock signal GCK in a period where the level of the gate start pulse signal GST is set to a high level.

The drive of the gate driver GD is based on the drive frequency of the gate clock signal GCK. In the rewrite period Pw, the gate driver GD firstly drives the gate lines G of the non-rewrite area NRA1 at the second drive frequency f2, then drives the gate lines G of the rewrite area RA at the first drive frequency f1, and then drives the gate lines G of the non-rewrite area NRA2 at the second drive frequency f2.

The gate driver GD outputs a second-level gate signal VG to the gate lines G of the non-rewrite areas NRA1 and NRA2. On the other hand, the gate driver GD sequentially outputs a first-level gate signal VG to the gate lines G of the rewrite area RA. At this time, the source driver SD supplies a source line voltage Vsig to the source lines S. As a result, the source line voltage Vsig is written to the pixel electrodes 11 of the rewrite area RA. For example, when a transition period Pt2 passes after the source line voltage Vsig is written to the pixel electrode 11 (i, j), the potential V11 (i, j) is determined. As a result, the voltage of each pixel PX of the rewrite area RA can be rewritten from the second transparent voltage VA2 to either the scattering voltage VB or the first transparent voltage VA1.

According to the display device DSP of the first embodiment which is constructed as described above, the user can see the image (characters) CH more easily. In other words, the user is less likely to be affected by the background when the user sees the image CH. Accordingly, it is possible to obtain the display device DSP which can improve the visibility of the background and the display quality.

With respect to pixels PX located in the non-rewrite area NRA such as the third pixel PXE (third liquid crystal layer 30E), the second transparent voltage VA2 is applied in the reset period Pr. After the reset period Pr, the pixels PX of the non-rewrite area NRA are held in a state of being subjected to the second transparent voltage VA2. Therefore, as compared to a case where the pixels PX of the non-rewrite area NRA are subjected to the first transparent voltage VA1, high transparency can be obtained in the non-rewrite area NRA.

The gate driver GD can collectively output the first-level gate signal VG to all the gate lines G in the reset period Pr. As a result, as compared to a case where the gate driver GD sequentially scans the gate lines G in the reset period Pr, the length of the reset period Pr can be shortened.

The gate driver GD has the sequential circuit SC and the like. In the rewrite period Pw such as the sub-frame period Psf, the gate driver GD can drive the second gate lines Gb at the second drive frequency f2 higher than the first drive frequency f1 at which the gate driver GD drives the first gate lines Ga. As a result, the scan period of the second gate lines Gb can be shortened.

In addition, as compared to a case where the gate driver GD scans all the gate lines G at the first drive frequency f1 in the rewrite period Pw, the frame rate can be increased. As a result, the occurrence of color breakup can be suppressed.

In addition, according to the configuration of the present embodiment, the display device DSP can be driven by the source driver SD having a low withstand voltage. This advantage will be described with reference to FIGS. 6 to 8.

As a comparative example, it is assumed that the common voltage Vcom is a DC voltage and only the polarity of the source line voltage Vsig is inverted with respect to the common voltage Vcom. In this case, by setting the source line voltage Vsig to the same voltage as the common voltage Vcom, it is possible to apply a voltage of 0 V (the second transparent voltage VA2) to the liquid crystal layer 30 of each pixel area even in normal display drive. However, in this comparative example, in order to use the scattering voltage of FIG. 6 for gradation expression, the source line voltage Vsig needs to be variable in a range of −16 V to +16 V with respect to the common voltage Vcom. That is, a circuit such as the source driver SD need to have a withstand voltage of 32 V.

On the other hand, according to the configuration of the present embodiment, the source line voltage Vsig and the common voltage Vcom only need to be variable in a range of, for example, 16 V as shown in FIG. 8. That is, a circuit such as the source driver SD only needs to have a withstand voltage of 16 V. It is possible to reduce the circuit size and the manufacturing cost by keeping the withstand voltage of the circuit low as described above.

In addition to those described above, various other advantages can be obtained from the present embodiment.

Second Embodiment

The second embodiment mainly focuses on differences from the first embodiment, and the descriptions of the same configurations as the first embodiment will be omitted.

Figure 17:
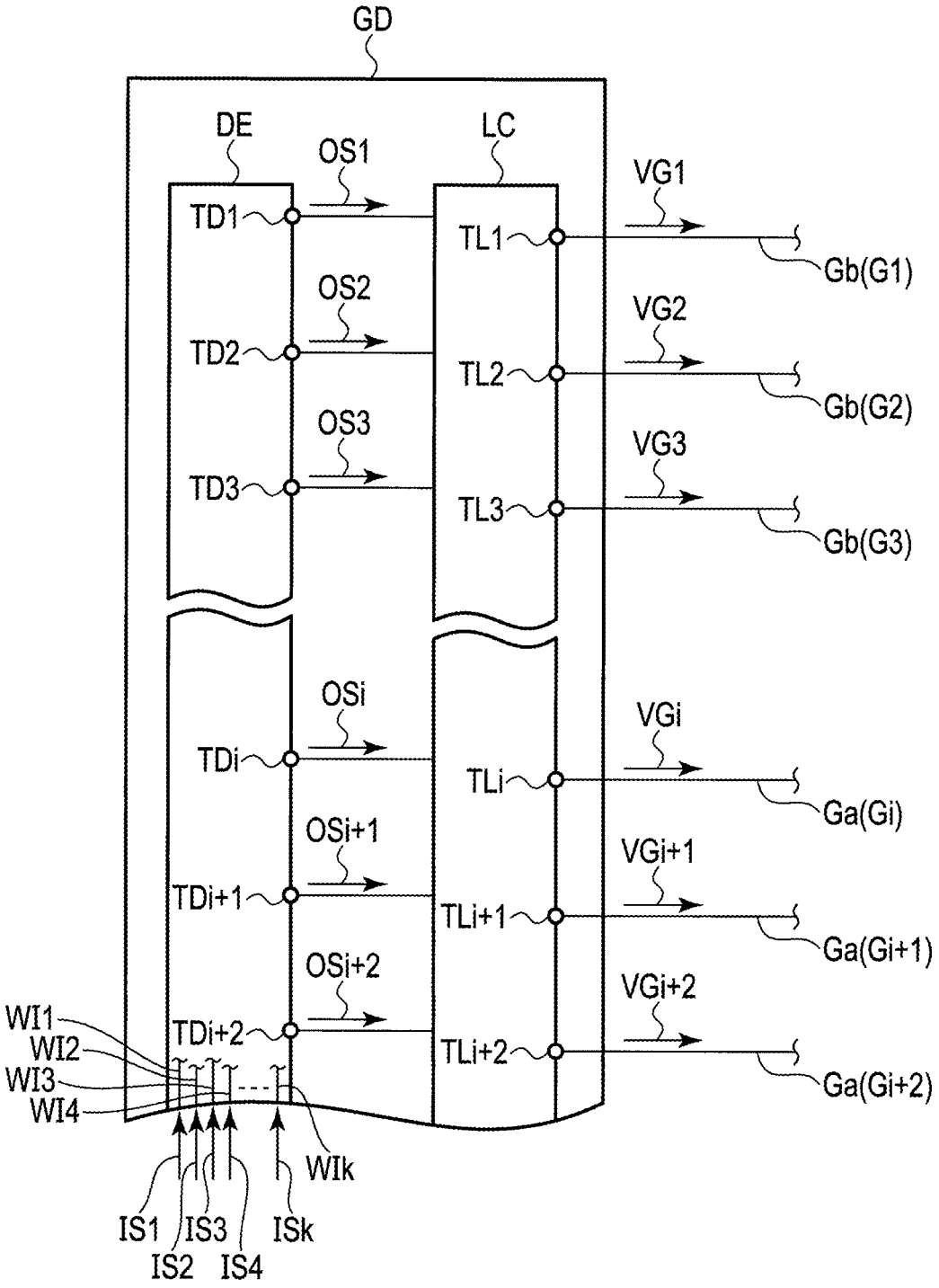
FIG. 17 is a circuit diagram showing a part of a gate driver and some gate lines of a display device according to a second embodiment.

As shown in FIG. 17, the gate driver GD includes at least a decoder DE. The decoder DE has k input wiring lines WI1 to WIk, and control signals IS1 to ISk are input to the input wiring lines WI1 to WIk, respectively. The decoder DE has a plurality of output terminals TD. For example, the output terminals TD are n output terminals TD1, TD2, . . . , TDi . . . , and TDn and the number of output terminals TD is the same as the number of gate lines G. Output signals OS1, OS2, . . . , OSi . . . are output from the output terminals TD1, TD2, . . . , TDi . . . , respectively. According to the level (either a high level or a low level) of each of the control signals IS1 to ISk, the decoder DE outputs a high-level output signal OS from one output terminal TD and outputs low-level output signals OS from the rest of the output terminals TD.

As described above, if the gate driver GD has the decoder DE, the gate driver GD can sequentially supply the first-level gate signal VG to all the gate lines G and can sequentially drive all the gate lines G in the reset period Pr.

The gate driver GD sequentially supplies the first-level gate signal VG to the first gate lines Ga and sequentially drives the first gate lines Ga in the rewrite period Pw. In addition, the gate driver GD supplies the second-level gate signal VG to the second gate lines Gb in the rewrite period Pw. Since the gate driver GD does not supply the first-level gate signal VG to the second gate lines Gb, the gate driver GD does not drive the second gate lines Gb in the rewrite period Pw. Accordingly, the gate driver GD can selectively drive the first gate lines Ga in the rewrite period Pw. It is not necessary to secure a drive period to drive the second gate lines Gb in the rewrite period Pw. As a result, for example, the frame rate can be increased.

In the present embodiment, the gate driver GD includes not only the decoder DE but also a logic circuit LC connected between the gate lines G and the decoder DE. The logic circuit LC has a plurality of output terminals TL. For example, the output terminals TL are n output terminals TL1, TL2, . . . TLi, . . . , and TLn and the number of output terminals TL is the same as the number of gate lines G. Gate signals VG1, VG2, . . . , VGi . . . are output from the output terminals TL1, TL2, . . . , TLi . . , respectively. When the gate driver GD uses the logic circuit LC, the gate driver GD can supply the first-level gate signal VG to only one gate line G and can simultaneously supply the first-level gate signal VG to some gate lines G.

Accordingly, the gate driver GD outputs the first-level gate signal VG to all the gate lines G and turns on all the switching elements SW in the reset period Pr. For example, the gate driver GD can simultaneously output the first-level gate signal VG to all the gate lines G in the reset period Pr.

The gate driver GD outputs the first-level gate signal VG to all the first gate lines Ga and turns on the switching elements SW of the rewrite area RA such as the first switching element SWC and the second switching element SWD in the rewrite period Pw. For example, the gate driver GD sequentially outputs the first-level gate signal VG to all the first gate lines Ga in the rewrite period Pw. Alternatively, the gate driver GD can simultaneously output the first-level gate signal VG to some first gate lines Ga of all the first gate lines Ga in the rewrite period Pw. For example, the gate driver GD can simultaneously output the first-level gate signal VG to the first gate lines Ga corresponding to rows to which only the non-object area NOA of the rewrite area RA belongs. In this case, it is possible to simultaneously write the first transparent voltage VA1 to pixels PX corresponding to rows to which only the non-object area NOA belongs.

On the other hand, regarding the second gate lines Gb, the gate driver GD outputs the second-level gate signal VG to all the second gate lines Gb and turns off the switching elements SW of the non-rewrite area NRA such as the third switching element SWE in the rewrite period Pw. For example, the gate driver GD holds a state of outputting the second-level gate signal VG to all the second gate lines Gb in the rewrite period Pw.

Figure 18:
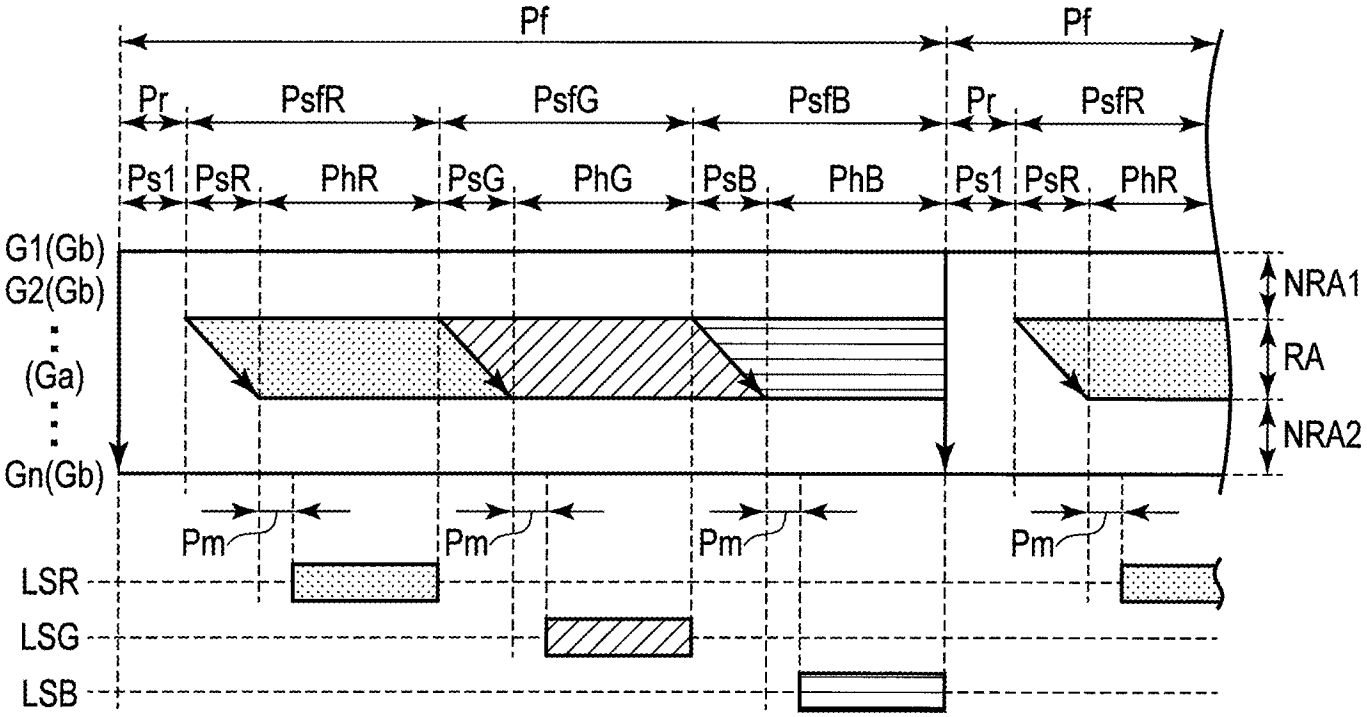
FIG. 18 is a timing chart showing an example of a display operation of a display device of the second embodiment.

FIG. 18 is a timing chart showing an example of the display operation of the display device DSP of the second embodiment.

As shown in FIG. 18, the frame period Pf includes the reset period Pr, the first sub-frame period PsfR, the second sub-frame period PsfG and the third sub-frame period PsfB. In this example, the reset period Pr is a foremost period of the frame period Pf. However, the time to which the reset period Pr is set and the frequency of the reset period Pr are variously modified as is the case with the above-described first embodiment.

In the reset period Pr, the gate driver GD simultaneously supplies the first-level gate signal VG to all the gate lines G1 to Gn, and the source driver SD supplies the source line voltage Vsig of the same value as the common voltage Vcom to each of all the source lines S1 to Sm. As a result, the second transparent voltage VA2 is written to all the pixels PX.

In the drive period PsR of the first sub-frame period PsfR, the gate driver GD supplies the high-level gate signal VG to the first gate lines Ga and drives the first gate lines Ga. The source driver SD supplies the source line voltage Vsig to each of the source lines S1 to Sm. The source line voltage Vsig is supplied to the pixel electrodes 11 of the pixels PX corresponding to the selected first gate line Ga via the switching elements SW, and as the switching elements SW are turned off, the potentials of the pixel electrodes 11 are held.

The gate driver GD does not drive the second gate lines Gb in the drive period PsR. In other words, the gate driver GD continuously supplies the second-level gate signal VG to the second gate lines Gb in the drive period PsR. The switching elements SW connected to the second gate lines Gb are held in an off state.

According to this operation, the voltage (scattering voltage VB) according to sub-frame data for red is written to the pixels PX of the object area OA such as the first pixel PXC, the first transparent voltage VA1 is written to the pixels PX of the non-object area NOA such as the second pixel PXD, and the pixels PX of the non-write area NRA such as the third pixel PXE are held in a state of being subjected to the second transparent voltage VA2.

Subsequently, the light-emitting element LSR is turned on in the hold period PhR. As a result, at least a part of the image CH displayed in the object area OA can be colored in red.

The operations in the second sub-frame period PsfG and the third sub-frame period PsfB are similar to the operation in the first sub-frame period PsfR.

In the second embodiment constructed as described above, the gate driver GD comprises the decoder DE. In the rewrite period Pw, the gate driver GD does not require a dedicated period to drive the second gate lines Gb. In the present embodiment, as compared to the above-described first embodiment, the drive period of the gate lines G in the rewrite period Pw can be shortened. The frame rate can be further increased, and the occurrence of color breakup can be further suppressed.

In addition to those described above, advantages similar to those of the first embodiment can be obtained.

(Modification of Second Embodiment)

Next, a modification of the above-described second embodiment will be described. In one frame period Pf, the display device DSP may be driven twice or more by using frame data. In other words, one frame period Pf of the present modification is a drive period using the same frame data. The technique of the present modification can be applied to the above-described first embodiment.

Figure 19:
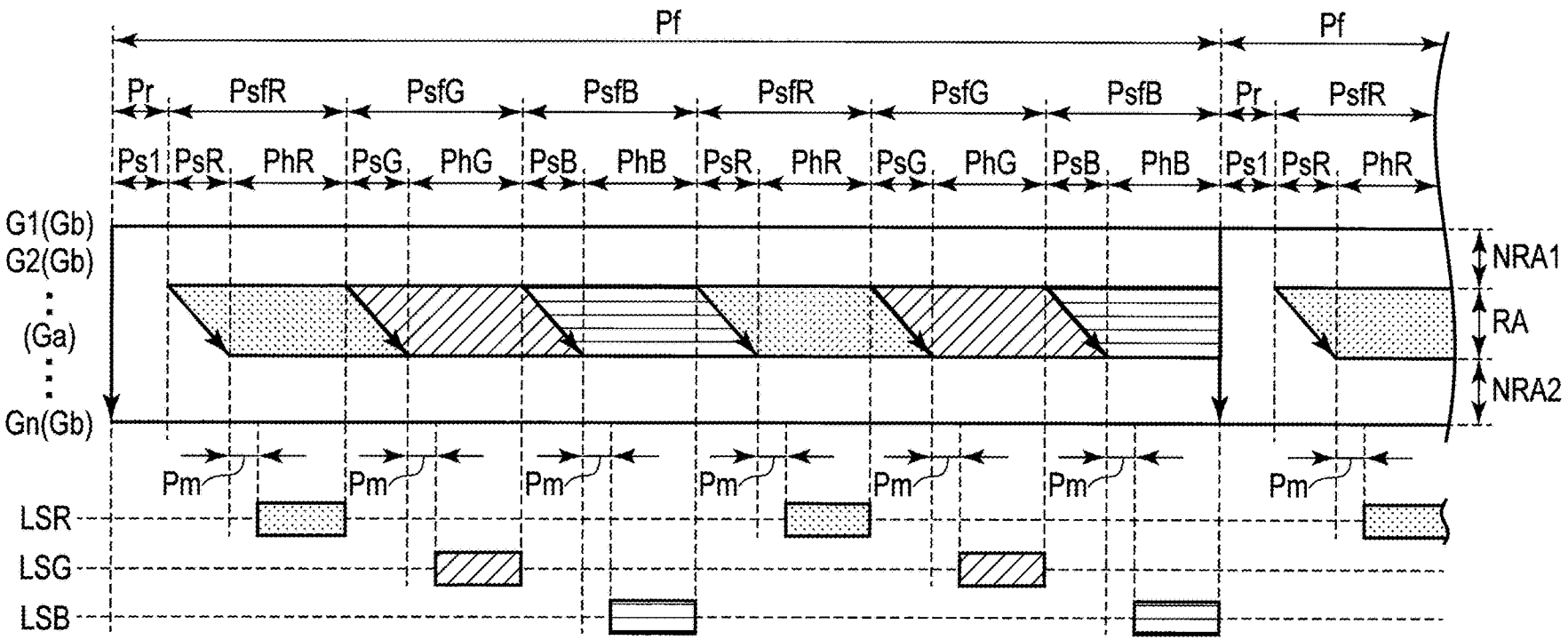
FIG. 19 is a timing chart showing an example of a display operation of a display device according to a modification example of the second embodiment.

As shown in FIG. 19, the display device DSP may be driven, for example, twice by using frame data in one frame period Pf. The frame period Pf includes one reset period Pr, two first sub-frame periods PsfR, two second sub-frame periods PsfG and two third sub-frame periods PsfB.

As is the case with the above-described second embodiment, it is possible to shorten the drive period by selectively driving the first gate lines Ga in each sub-frame period Psf. As a result, the on periods of the light-emitting elements LSR, LSG and LSB can be segmented, and the occurrence of color breakup can be suppressed.

In the present modification also, the time to which the reset period Pr is set and the frequency of the reset period Pr can be variously modified.

Third Embodiment

The third embodiment mainly focuses on differences from the first embodiment, and the descriptions of the same configurations as the first embodiment will be omitted.

Figure 20:
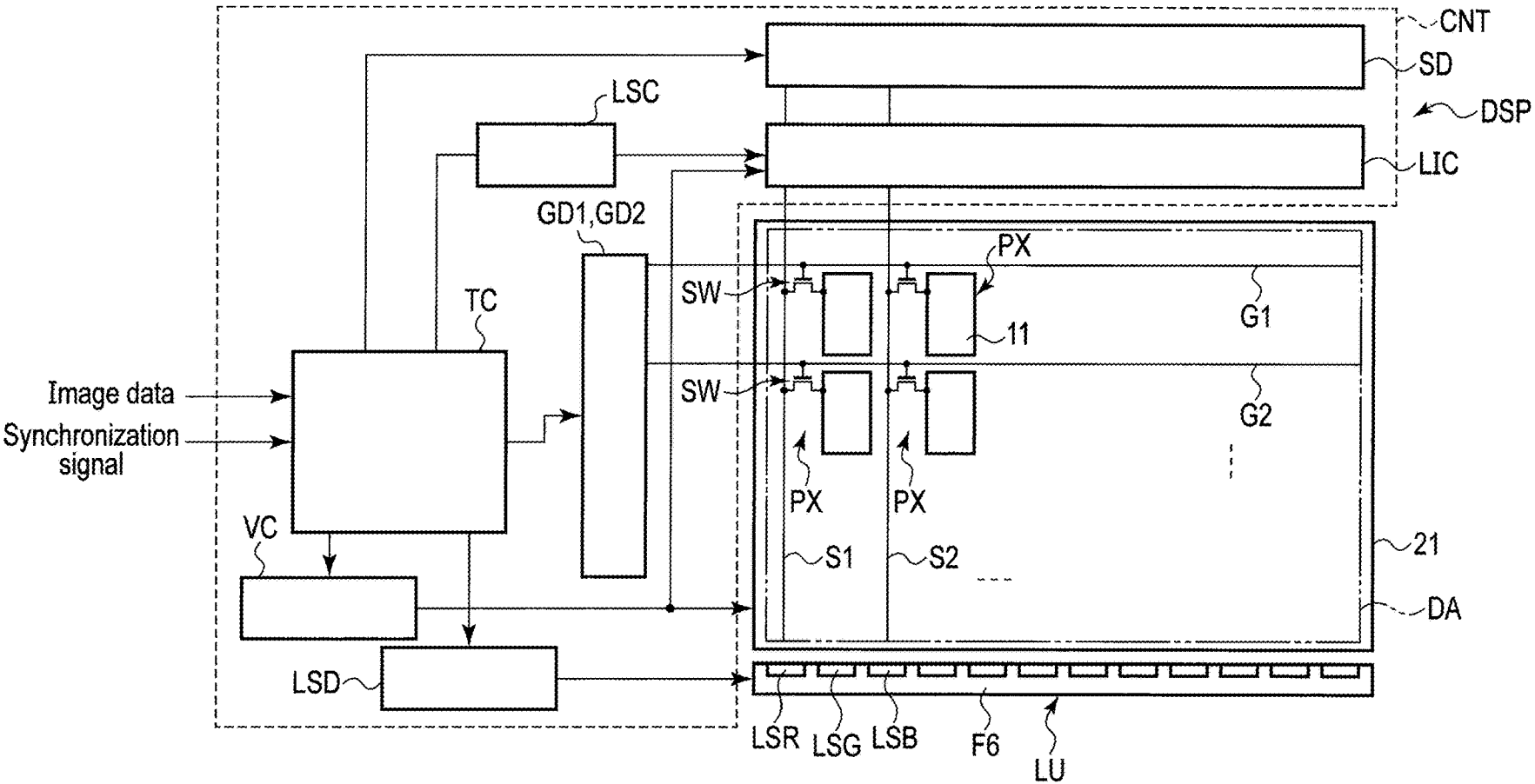
FIG. 20 is an illustration showing main constituent elements of a display device according to a third embodiment.

FIG. 20 is an illustration showing the main constituent elements of the display device DSP of the present embodiment.

As shown in FIG. 20, the configuration of the display device DSP differs from the configuration shown in FIG. 3 in that the controller CNT comprises a level conversion circuit (level shift circuit) LSC and a Vcom draw-in circuit LIC.

The common voltage (Vcom) supplied from the Vcom circuit VC is supplied to the common electrode 21 and is also supplied to the Vcom draw-in circuit LIC. The Vcom draw-in circuit LIC is interposed between the source driver SD and the source lines S. The Vcom draw-in circuit LIC supplies a video signal output from the source driver SD to each source line S. In addition, the Vcom draw-in circuit LIC can supply the common voltage from the Vcom circuit VC to each source line S.

Figure 21:
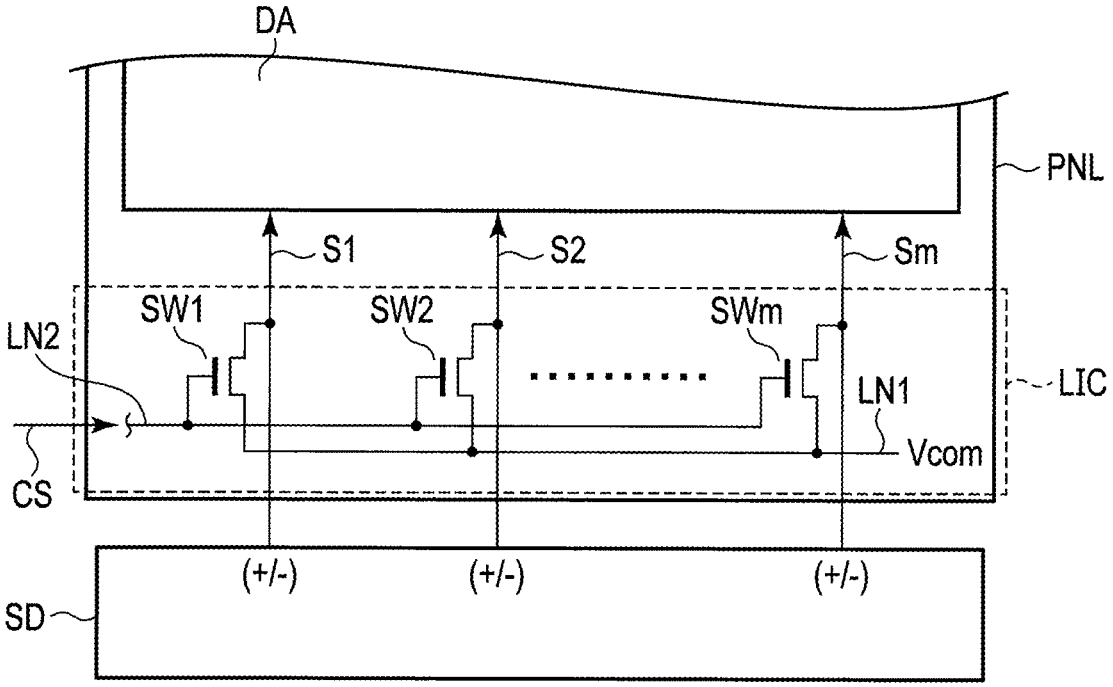
FIG. 21 is an illustration showing a configuration example of a Vcom draw-in circuit shown in FIG. 20.

FIG. 21 is an illustration showing a configuration example of the Vcom draw-in circuit LIC. The Vcom draw-in circuit LIC comprises switching elements SW1 to SWm. The switching elements SW1 to SWm are arranged, for example, on the first substrate SUB1 of the display panel PNL. A wiring line LN1 is connected to the input terminals (sources) of the switching elements SW1 to SWm, source lines S1 to Sm are connected to the output terminals (drains), and a wiring line LN2 is connected to the control terminal (gates).

The Vcom circuit VC shown in FIG. 20 supplies the common voltage Vcom to the wiring line LN1. Note that this operation can be applied to the drive in the write operation of the second transparent voltage VA2 to the pixels PX of the non-rewrite area NRA, the drive in the reset period Pr, or both the drive in the write operation of the second transparent voltage VA2 to the pixels PX of the non-rewrite area NRA and the drive in the reset period Pr. In addition, the timing controller TC outputs a control signal CS to the level conversion circuit LSC at the time of execution of the transparent drive. The level conversion circuit LSC converts the control signal CS to a voltage having a predetermined level and supplies the voltage to the wiring line LN2. When the control signal CS is supplied to the wiring line LN2, the wiring line LN1 and each of the source lines S1 to Sm become electrically continuous with each other, and the common voltage Vcom of the wiring line LN1 is supplied to each of the source lines S1 to Sm.

If a gate signal is supplied to each of the gate lines G1 to Gn in a state in which the common voltage Vcom is supplied to each of the source lines S1 to Sm as described above, the common voltage Vcom of each of the source lines S1 to Sm is supplied to each pixel electrode 11. That is, the potential difference between each pixel electrode 11 and the common electrode 21 becomes 0 V (the second transparent voltage VA2).

According to the configuration of the present embodiment, transparent drive similar to that of the first embodiment can be executed. The transparent drive can be executed with timing similar to that of the first embodiment. According to the configuration of the present embodiment, it is not necessary to provide a circuit or the like which supplies a voltage (for example, the common voltage Vcom) for the transparent drive to the source driver SD.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or examples as would fall within the scope and spirit of the inventions. It is possible to combine two or more of the embodiments and the examples with each other if needed.

The sub-frame data stored in the line memories 52R, 52G and 52B are examples of the first sub-frame data indicating an image having the first color, the second sub-frame data indicating an image having the second color and the third sub-frame data indicating an image having the third color.

The first, second and third colors are not limited to red, green and blue, respectively. In addition, the light source unit LU may comprise light-emitting elements LS for two or less colors or may comprise light-emitting elements LS for four or more colors. Alternatively, the light source unit LU may comprise a light-emitting element LS for white. It is only necessary to increase or reduce the numbers of line memories, sub-frame data and sub-frame periods according to the number of types (number of colors) of light-emitting elements LS.

The liquid crystal layer 30 may employ normal-mode polymer dispersed liquid crystal. The above-described liquid crystal layer 30 maintains the degree of parallelism of incident light in a case where an applied voltage is high and scatters incident light in a case where an applied voltage is low.

What is claimed is:

1. A display device comprising:

a display panel comprising a plurality of gate lines, a plurality of pixel electrodes located in a display area, a common electrode located in the display area, and a display function layer located in the display area;

a light source unit which is located in a non-display area outside the display area and emits light to the display function layer; and a control unit which includes a gate driver connected to the gate lines and controls drive of the gate lines, the pixel electrodes, the common electrode and the light source unit, wherein at a time of image display in an object area of the display area, the control unit sets the display area to a second transparent state in which a degree of transparency is higher than a degree of transparency of a first transparent state in a reset period, displays an image in the object area, sets a non-object area other than the object area of a rewrite area which includes an entire area of rows in which the object area is located, to the first transparent state, and holds a non-rewrite area other than the rewrite area of the display area in the second transparent state, in a rewrite period after the reset period, and the gate driver includes a sequential circuit, and drives a plurality of second gate lines electrically connected to the pixel electrodes located in the non-rewrite area of the gate lines, at a second drive frequency higher than a first drive frequency at which the gate driver drives a plurality of first gate lines electrically connected to the pixel electrodes located in the rewrite area of the gate lines in the rewrite period, or includes a decoder, and selectively drives the first gate lines in the rewrite period.

2. The display device of claim 1, wherein the display function layer is a liquid crystal layer employing reverse-mode polymer dispersed liquid crystal.

3. The display device of claim 1, wherein the pixel electrodes include a first pixel electrode located in the object area, a second pixel electrode located in the non-object area and a third pixel electrode located in the non-rewrite area, the display function layer includes a first display function layer located in the object area and subjected to a voltage applied between the first pixel electrode and the common electrode, a second display function layer located in the non-object area and subjected to a voltage applied between the second pixel electrode and the common electrode, and a third display function layer located in the non-rewrite area and subjected to a voltage applied between the third pixel electrode and the common electrode, and the control unit applies a second transparent voltage to the display function layer in the reset period, and applies a scattering voltage to the first display function layer, applies a first transparent voltage to the second display function layer and holds a state in which the second transparent voltage is applied to the third display function layer in the rewrite period.

4. The display device of claim 3, wherein the display function layer is a liquid crystal layer employing reverse-mode polymer dispersed liquid crystal, and the second transparent voltage is 0 V.

5. The display device of claim 4, wherein the scattering voltage includes a scattering voltage having positive polarity and a scattering voltage having negative polarity, and at a time of image display in the object area, the control unit alternately applies the scattering voltage having positive polarity and the scattering voltage having negative polarity to the first display function layer in each frame period.

6. The display device of claim 3, wherein in the rewrite period, the first display function layer scatters incident light, and each of the second display function layer and the third display function layer maintains a degree of parallelism of incident light, and the degree of parallelism of light maintained in the third display function layer is higher than the degree of parallelism of light maintained in the second display function layer.

7. The display device of claim 1, wherein the gate driver includes the sequential circuit, a control wiring line and a plurality of logical sum circuits, the gate lines include a plurality of first gate lines and a plurality of second gate lines, the display panel further includes a plurality of switching elements including a first switching element connected to one corresponding first gate line of the first gate lines, a second switching element connected to one corresponding first gate line of the first gate lines, and a third switching element connected to one corresponding second gate line of the second gate lines, the pixel electrodes includes a first pixel electrode located in the object area and connected to the first switching element, a second pixel electrode located in the non-object area and connected to the second switching element, and a third pixel electrode located in the non-rewrite area and connected to the third switching element, each of the logical sum circuits includes a first input terminal connected to the sequential circuit, a second input terminal connected to the control wiring line, and an output terminal connected to one corresponding gate line of the gate lines, the logical sum circuits include a plurality of first logical sum circuits and a plurality of second logical sum circuits, each of the first logical sum circuits is connected to one corresponding first gate line of the first gate lines, and each of the second logical sum circuits is connected to one corresponding second gate line of the second gate lines, the control unit supplies a second input signal having a high level to the control wiring line, outputs a gate signal having a first level to all the gate lines and turns on all the switching elements in the reset period, supplies the second input signal having a low level to the control wiring line, sequentially supplies a first input signal having a high level to the first input terminals of all the first logical sum circuits, sequentially outputs the gate signal having the first level to all the first gate lines, turns on the first switching element and the second switching element, sequentially supplies the first-input signal having a low level to the first input terminals of all the second logical sum circuits, sequentially outputs the gate signal having a second level to all the second gate lines, and turns off the third switching element in the rewrite period.

8. The display device of claim 1, wherein the gate driver includes a sequential circuit, the control unit supplies a gate clock signal having the first drive frequency and the second drive frequency to the gate driver, and the gate driver scans the rewrite area and the non-rewrite area at different drive frequencies based on the gate clock signal.

9. The display device of claim 1, wherein the gate driver includes the decoder and a logic circuit connected between the gate lines and the decoder, the gate lines include a plurality of first gate lines and a plurality of second gate lines, the display panel further includes a plurality of switching elements including a first switching element connected to one corresponding first gate line of the first gate lines, a second switching element connected to one corresponding first gate line of the first gate lines, and a third switching element connected to one corresponding second gate line of the second gate lines, the pixel electrodes includes a first pixel electrode located in the object area and connected to the first switching element, a second pixel electrode located in the non-object area and connected to the second switching element, and a third pixel electrode located in the non-rewrite area and connected to the third switching element, the control unit outputs a gate signal having a first level to all the gate lines and turns on all the switching elements in the reset period, and outputs the gate signal having the first level to all the first gate lines, turns on the first switching element and the second switching element, outputs the gate signal having a second level to all the second gate lines, and turns off the third switching element in the rewrite period.

10. The display device of claim 1, wherein the light source unit includes a first light-emitting element which emits light having a first color to the display function layer, a second light-emitting element which emits light having a second color to the display function layer and a third light-emitting element which emits light having a third color to the display function layer, each frame period includes a first sub-frame period in which the first light-emitting element emits the light having the first color, a second sub-frame period in which the second light-emitting element emits the light having the second color and a third sub-frame period in which the third light-emitting element emits the light having the third color, and the control unit alternately sets the reset period and each of the sub-frame periods, alternately sets the reset period and the sub-frame periods, sets the reset period once every frame period, or sets the reset period once every few frame periods.

* * * * *